US007901335B2

(12) United States Patent
Webber et al.

(10) Patent No.: US 7,901,335 B2
(45) Date of Patent: Mar. 8, 2011

(54) MULTI-STATION EXERCISE MACHINE

(75) Inventors: Randall T. Webber, La Jolla, CA (US); Bruce Hockridge, San Diego, CA (US); Jeffrey O. Meredith, Del Mar, CA (US); Christopher E. Brennan, Murrieta, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 165 days.

(21) Appl. No.: 12/142,636

(22) Filed: Jun. 19, 2008

(65) Prior Publication Data

US 2008/0248929 A1 Oct. 9, 2008

Related U.S. Application Data

(63) Continuation-in-part of application No. 10/633,805, filed on Aug. 4, 2003, now Pat. No. 7,594,880, which is a continuation-in-part of application No. 11/846,472, filed on Aug. 28, 2007, which is a continuation-in-part of application No. 11/848,012, filed on Aug. 30, 2007.

(51) Int. Cl.
*A63B 21/00* (2006.01)

(52) U.S. Cl. ..... 482/72; 482/140; 482/142

(58) Field of Classification Search ..... 482/95, 482/96, 130, 104–106, 72, 51, 142
See application file for complete search history.

(56) References Cited

U.S. PATENT DOCUMENTS

| | | | | |
|---|---|---|---|---|
| 248,121 | A | | 10/1881 | Tuttle |
| 2,145,940 | A | | 2/1939 | Marlowe |
| 2,252,156 | A | | 8/1941 | Bell |
| 3,446,503 | A | | 5/1969 | Lawton |
| 3,640,528 | A | * | 2/1972 | Proctor ..... 482/102 |
| 4,111,414 | A | | 9/1978 | Roberts |
| 4,300,760 | A | | 11/1981 | Bobroff |
| 4,390,179 | A | | 6/1983 | Szkalak |
| 4,441,708 | A | | 4/1984 | Brentham |

(Continued)

FOREIGN PATENT DOCUMENTS

| | | |
|---|---|---|
| CA | 2075331 | 2/1994 |

OTHER PUBLICATIONS

Cybex Mg 5OO Multi-Gym, Cybex Brochure, 2000.

(Continued)

*Primary Examiner* — Jerome Donnelly
(74) *Attorney, Agent, or Firm* — Procopio, Cory, Hargreaves & Savitch LLP

(57) ABSTRACT

A multi-station exercise machine in one embodiment comprises at least two exercise stations for performing different exercises, at least one of the stations having a main frame, a user support frame pivotally associated with the main frame, a user engagement device movably mounted on one of the frames for actuating by a user in order to perform an exercise, and a connecting linkage which links movement of the user engagement device to movement of the user support. A load provides resistance to movement of the user support frame, user engagement device and/or connecting linkage. The connecting linkage, user support pivot, and user engagement device mount are arranged so that movement of the user engagement device results in self-aligning movement of the user support. The other station may have a fixed user support or a moving user support.

76 Claims, 23 Drawing Sheets

U.S. PATENT DOCUMENTS 4,577,861 A * 3/1986 Bangerter et al. ..... 482/79
4,641,833 A 2/1987 Trethewey
4,743,010 A 5/1988 Geraci
4,790,530 A 12/1988 Maag
4,822,038 A 4/1989 Maag
4,844,456 A 7/1989 Habing et al.
4,917,379 A 4/1990 Maag
4,943,051 A 7/1990 Haskins et al.
4,944,641 A 7/1990 Alves
4,949,958 A 8/1990 Richey
5,011,139 A 4/1991 Towley
5,108,095 A 4/1992 Nichols
5,236,406 A 8/1993 Webber
5,254,067 A 10/1993 Habing et al.
5,299,997 A 4/1994 Chen
5,322,489 A 6/1994 Webb
5,330,404 A 7/1994 Lopeteguy et al.
5,330,405 A 7/1994 Habing
5,334,120 A 8/1994 Rasmussen
5,342,269 A 8/1994 Huang
5,342,270 A 8/1994 Jones
5,352,171 A 10/1994 Lin
5,354,248 A 10/1994 Rawls et al.
5,356,357 A 10/1994 Wang
5,356,358 A * 10/1994 Chen ..... 482/96
D357,041 S 4/1995 McBride et al.
5,417,634 A 5/1995 Habing
5,449,959 A 9/1995 Yang
5,453,066 A 9/1995 Richter
5,458,553 A 10/1995 Wu
5,478,298 A 12/1995 Chen
5,486,150 A 1/1996 Randolph
5,498,222 A 3/1996 Hur
5,503,608 A 4/1996 Chang
5,505,679 A 4/1996 McBride et al.
5,507,710 A 4/1996 Chen
5,518,477 A 5/1996 Simonson
5,520,599 A 5/1996 Chen
5,527,243 A 6/1996 Chen
5,527,250 A 6/1996 Chen
5,533,953 A 7/1996 Lui et al.
5,540,639 A 7/1996 Potts
D372,509 S 8/1996 Yang
5,547,443 A * 8/1996 Chen ..... 482/72
5,547,444 A 8/1996 Huang et al.
5,573,482 A * 11/1996 Wang et al. ..... 482/96
5,580,340 A 12/1996 Yu
5,582,563 A 12/1996 Fan
5,603,678 A 2/1997 Wilson
5,616,105 A 4/1997 Wang et al.
5,626,542 A 5/1997 Dalebout et al.
5,643,147 A 7/1997 Huang
D383,814 S 9/1997 Ward
5,669,865 A 9/1997 Gordon
5,674,161 A 10/1997 Lin
5,683,334 A 11/1997 Webber
5,695,435 A 12/1997 Dalebout et al.
5,720,695 A 2/1998 Eckmann
5,722,918 A 3/1998 Lee
5,733,232 A 3/1998 Hsu
5,810,698 A 9/1998 Hullett et al.
5,876,095 A 3/1999 Johnston
5,899,836 A 5/1999 Chen
5,938,570 A 8/1999 Maresh
5,944,641 A 8/1999 Habing
5,961,427 A 10/1999 Habing et al.
5,961,428 A 10/1999 Webber
6,004,247 A 12/1999 Webber
6,056,675 A * 5/2000 Aruin et al. ..... 482/91
6,135,930 A 10/2000 Kuo
6,142,914 A 11/2000 Crawford et al.
6,162,153 A 12/2000 Perez et al.
6,244,995 B1 6/2001 Prsala
6,251,047 B1 6/2001 Stearns
6,264,588 B1 7/2001 Ellis
6,312,366 B1 11/2001 Prusick
6,319,178 B1 11/2001 Webber
6,491,609 B2 12/2002 Webber
6,561,960 B2 * 5/2003 Webber ..... 482/138
6,579,213 B1 6/2003 Webber et al.
6,605,024 B2 * 8/2003 Stearns ..... 482/142
6,752,748 B1 * 6/2004 Scotti ..... 482/140
6,811,522 B1 11/2004 McQuinn
6,855,098 B2 2/2005 Reitz et al.
6,916,278 B2 7/2005 Webber
6,971,978 B2 12/2005 Hyder
7,052,444 B2 5/2006 Webber
7,052,446 B2 5/2006 Morris et al.
7,070,545 B2 7/2006 Lull et al.
7,141,003 B2 11/2006 Wu
7,141,008 B2 11/2006 Krull et al.
7,166,066 B2 1/2007 Webber
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,361,125 B2 4/2008 Webber et al.
7,384,381 B2 6/2008 Webber et al.
7,468,024 B2 12/2008 Webber et al.
7,553,263 B2 6/2009 Webb et al.
2002/0013199 A1 1/2002 Giannelli et al.
2002/0183173 A1 12/2002 Abelbeck
2002/0187879 A1 12/2002 Ball et al.
2003/0199362 A1 10/2003 Chamberlin
2005/0032611 A1 2/2005 Webber et al.
2006/0116253 A1 * 6/2006 Nizam ..... 482/94
2006/0247107 A1 11/2006 Carter
2006/0276313 A1 12/2006 Hong
2007/0232462 A1 10/2007 Webber et al.
2007/0232467 A1 10/2007 Puzey
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214365 A1 9/2008 Webber et al.
2008/0214367 A1 9/2008 Webber et al.
2008/0220950 A1 9/2008 Webber et al.
2008/0234110 A1 9/2008 Webber et al.
2008/0242517 A1 10/2008 Webber et al.

OTHER PUBLICATIONS

Power Station by Boss, Boss Fitness Systems, Inc. (Date Unknown).
Powertec Multi-Leverage System, Powertec (Date Unknown).
Maxicam Modular Machine, Muscle Dynamics Brochure, Apr. 1989.
Hoist 4000 Plus, Hoist Fitness Systems, 1989.
Hoist H4600, Hoist Fitness Systems, 1997.

* cited by examiner

MULTI-STATION EXERCISE MACHINE

RELATED APPLICATION

The present application is a Continuation-In-Part of co-pending U.S. patent application Ser. No. 10/633,805 filed on Aug. 4, 2003, and is also a Continuation-In-Part of co-pending U.S. patent application Ser. No. 11/846,472 filed on Aug. 28, 2007, and is also a Continuation-In-Part of co-pending U.S. patent application Ser. No. 11/848,012 filed on Aug. 30, 2007, and the contents of each of the aforementioned co-pending applications are incorporated herein by reference in their entirety,

BACKGROUND

1. Field of the Invention

This invention relates generally to exercise machines, and is particularly concerned with a multi-station exercise machine in which at least one station has a pivoting user support.

2. Related Art

There are several different types of exercise for exercising back muscles, including mid-row exercises. There are two basic types of exercise movements, isolation and compound. Isolation movements are designed to isolate a specific muscle or muscle group and to reduce body part movement to involve rotation of a single joint. Leg extensions and biceps curls are examples of isolation movements. Compound movement exercises involve more than one body part and require multiple joint action. Because of this, they exercise a greater number of muscles/muscle groups. There is also a difference in the travel path for the two types of movement. Isolation movements tend to be rotational with concentric travel paths, while compound movements tend to be curvilinear, with elliptical travel paths.

Compound movements are a natural and fundamental form of exercise and show up in everything from professional athletics to everyday activities. Jumping, rowing, swimming, and throwing all involve multi-joint movements. Squats, bench presses, chin-ups, bar dips, shoulder presses, and the like, are all compound movement exercises. While fundamental in everyday life, they can be difficult for many people to perform as exercises, requiring balance and coordination as well as strength to follow the proper movement path. Improper form by the exerciser can make the exercise more difficult, increase stress on the joints, and even lead to possible injury.

Various exercise machines have been developed for performing compound movement exercises involving different muscles and muscle groups. Some of these have a stationary user support, while others have a pivoting or movable user support, which may or may not be linked to the exercise arm or user engagement means. One problem in most or all prior art designs is the unnatural and exaggerated arcing movement found in pivoting arm exercise machines, which do not accurately simulate the natural body movement found in free weight and/or free bar exercises.

Movable user supports linked to the movement of an exercise arm are fairly common in single station exercise machines. U.S. Pat. No. 2,252,156 of Bell and U.S. Pat. No. 6,251,047 of Steams show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slideably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in multi-purpose exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another multi-purpose exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight will oppose the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition. The user support consists of a seat portion and a backrest portion, which are pivotally connected together. The user support is pivotally connected to a main frame, as is a first exercise arm. This first exercise arm provides pressing and pulldown exercises. A second exercise arm is pivotally connected to the user support for providing leg exercises. This second arm travels with the seat portion of the user support. A connecting link pivotally connects the first exercise arm with the user support so that movement in the arm forces movement in the user support. The link connects to the user support at the same pivot that joins the seat portion with the backrest portion. In a second embodiment a flexible line connects the user support with the main frame and has user-engaging handles attached to one end so that movement to the handles results in movement to the user support. In this design, the flexible line acts as both connecting link and exercise arm. In both designs, the seat and backrest do not travel in a fixed relationship to each other and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance. Movement of the user support is designed to be an exercise of its own, rather than providing proper positioning/alignment of the user relative to the exercise arm. The folding and unfolding of the two-piece user support constantly works the abdominal and low back muscles, which means that these muscles are being worked even when other exercises are being performed. The user cannot truly isolate any one specific muscle or muscle group. The stomach cannot be worked without working the low back, the arms, chest, shoulders, upper back and legs all must be worked with one another or at the least with both the stomach and low back. Because of this the user cannot fully fatigue other muscles as the abdominals and low back would fatigue first.

A squat exercise apparatus is described in both U.S. Pat. No. 5,108,095 of Nichols and U.S. Pat. No. 5,603,678 of Wilson. In Nichols, a four bar linkage system is used to keep the user support (back pad and shoulder pads) vertical while it is being moved along an arcuate exercise path. This design requires a belt around the user's waist to keep them in the proper position, and is awkward to use. The entire weight of the moving carriage is positioned on one side of the pivotal connection to the main frame, creating an initial starting weight or resistance which may be too heavy for most users, and requires addition of a counter balance to offset the carriage weight. This in turn poses a hazard to anyone standing next to, or walking past, the moving part. Wilson has a generally T-shaped user support frame rotatably mounted on the base of the stationary frame. A back pad, handgrips, and resistance receiving means are all attached to the pivoting user support frame. The user pushes against a fixed foot plate in order to pivot the backrest. There is no secondary user support to properly position the user, and improper positioning could result in serious injury.

Various exercise machines are also known which allow users to perform chin up and/or bar dip exercises. Some examples of these machines are described in U.S. Pat. No. 3,592,465 of Fulkerson, U.S. Pat. No. 3,707,285 of Martin, U.S. Pat. No. 4,111,414 of Roberts, U.S. Pat. No. 5,011,139 of Towley, U.S. Pat. No. 5,322,489 of Webb, U.S. Pat. No. 5,449,959 of Holmes, and U.S. Pat. No. 5,540,639 of Potts. In these machines, the user sits or stands on a movable user support, and pushes or pulls with their hands in order to raise their body, assisted by the counter-balanced user support. While the user support moves in these designs, it is not urged to do so by movement of an exercise arm. The only user engaging means or handles are stationary and fixed to the main frame. A further disadvantage of these machines is the limitation of the handle or user gripping position, which may put the hand and/or wrist of the user in an uncomfortable position at some point in the movement, causing undue strain which may lead to injury. U.S. Pat. No. 248,121 of Tuttle and U.S. Pat. No. 5,876,095 of Johnston describe exercise machines for performing dips in which a movable user support or platform is linked to an exercise arm, so that movement of the exercise arm forces movement of the user support. Both of these designs have the user support traveling upward in a generally vertical direction while the user support remains horizontal, and both place the exerciser's wrist in an awkward starting position. Neither of these designs describes or suggests orienting or aligning the position of the user support to the position of the exercise arm or user engaging means.

Current exercise machines for performing compound or multi-joint exercises, whether using composite motion or a fixed user support, do not accurately maintain proper positioning of the user throughout the exercise motion, can result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, causing strain and potential injury.

SUMMARY

Embodiments described herein provide for a multi-station exercise machine with a pivoting user support at one or more of the exercise stations.

A multi-station exercise machine in one embodiment comprises at least two exercise stations for performing different exercises, at least a first one of the stations having a main frame, a user support frame pivotally associated with the main frame, a user engagement device movably mounted on one of the frames for actuating by a user in order to perform an exercise, and a connecting linkage which translates movement of the user engagement device to movement of the user support. A load provides resistance to movement of the user support frame, user engagement device and/or connecting linkage. The connecting linkage, user support pivot, and user engagement device mount are arranged so that movement of the user engagement device results in self-aligning movement of the user support.

The user support frame of the first station in an exemplary embodiment has both a primary user support, such as a seat pad or back pad, and one or more secondary user supports. One secondary user support may be a back pad, shoulder pad, thigh hold-down pads, chest pad, or the like. Another secondary or additional user support may be a foot rest, which may be mounted on, and travel with, the user support frame. Alternatively, a foot rest may be mounted on the main frame. In either case, the foot rest provides additional stabilization to the user, helping them to maintain a proper exercise position and providing additional comfort and support. The use of multiple support pads on the user support frame helps to position the exerciser properly and safely. These supports are in fixed alignment to each other and travel together, keeping the user in the same braced position throughout the entire exercise range of motion. This allows the user to focus on the exercise rather than worrying about their positioning on a moving platform or seat.

The exercise arm or user engagement device is movably mounted on the main frame, the user support frame, or the connecting linkage. The connecting linkage translates movement of the exercise arm to movement of the user support, and is movably engaged with at least two of the main frame, exercise arm, and user support. In one embodiment, the user engagement device is movably mounted on the main frame and associated with the connecting linkage. The user support and exercise arm may both be movably mounted on the main frame, with the connecting linkage connected between them. The exercise arm may be mounted for linear movement or may be pivotally mounted for rotational movement.

The user support frame may be pivotally mounted on the base of the main frame so that it is relatively low to the ground and readily accessible to the user in entering and exiting the machine, via a single pivot or a multiple pivot assembly. In one embodiment, the user engagement device is also movably mounted on the base of the main frame. In other embodiments, the user engagement device is movably mounted relative to an upright portion of the main frame. The user engagement device may comprise completely rigid or partially rigid exercise arms with handles for gripping by the user which are movable between a start position and an end position. The user's hands may be at a different elevation in the end position than in the start position.

A pivot assembly which pivotally supports the user support frame may be located beneath the user support frame. The connecting linkage may be rigid, flexible, or partially flexible, and may be adjustable in length or position. The user engagement device or exercise arm may have one or two handles. If handles are provided, they may be rigid or flexible, fixed or self-aligning, and may provide two dimensional or three dimensional movement.

Where the user engagement device comprises two exercise arms, the exercise arms may be movable independently or in unison. In one embodiment, the user engagement device and connecting linkage are both movably associated with the main frame. The user engagement device may be a bi-directional exercise arm.

The pivot mounting of the user support defines a vertical gravitational center line of the pivotal movement, and in one embodiment portions of the combined weight of the user and user support frame are positioned on both sides of the vertical gravitational center line in at least one of the start and end positions of the exercise. In one embodiment, a portion of the combined weight of the user and user support is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the gravitational center line of the pivoting movement, resulting in either a high initial lifting resistance, or else a resistance "drop off" at the end of the exercise.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage. Where the exercise resistance is a weight stack, multiple exercise stations may share the same weight stack or load for exercise resistance, or separate weight stacks may be provided for each station.

The multi-station exercise machine may have one or more exercise stations with pivoting user supports as described above, and the exercise stations with moving user supports may be designed for performing various types of exercises, including both compound and isolation exercises. In one embodiment, the exercise stations are adapted for performing different exercises.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a multi-station exercise machine having multiple exercise stations, at least one of which has an exercise arm or user engagement device and pivoting user support which travel in a dependent relationship.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
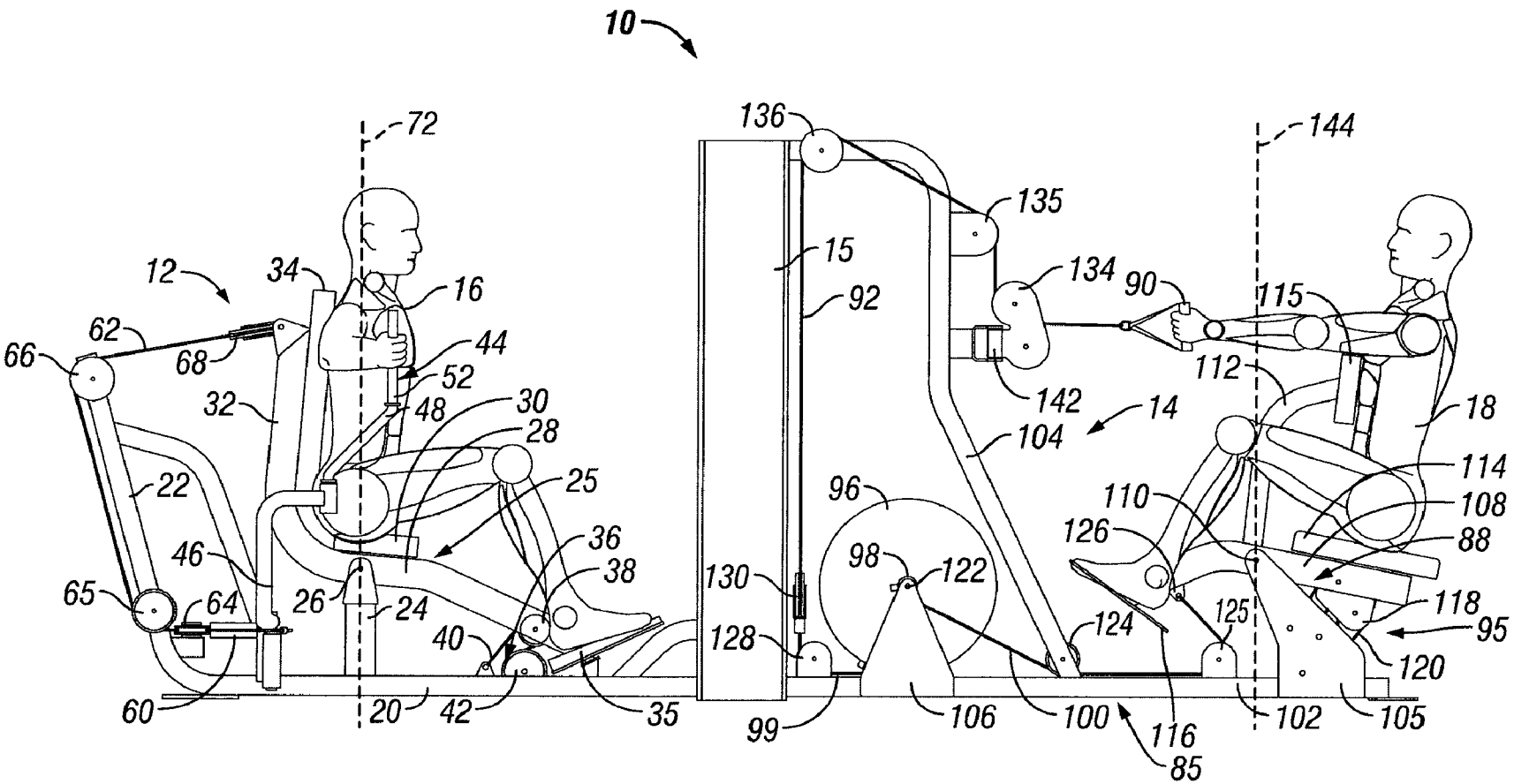
FIG. 1 is a side elevation view of a multi-station exercise machine according to one embodiment, with a user seated on each station in a start position adopted at the beginning of an exercise movement.
Figure 2:
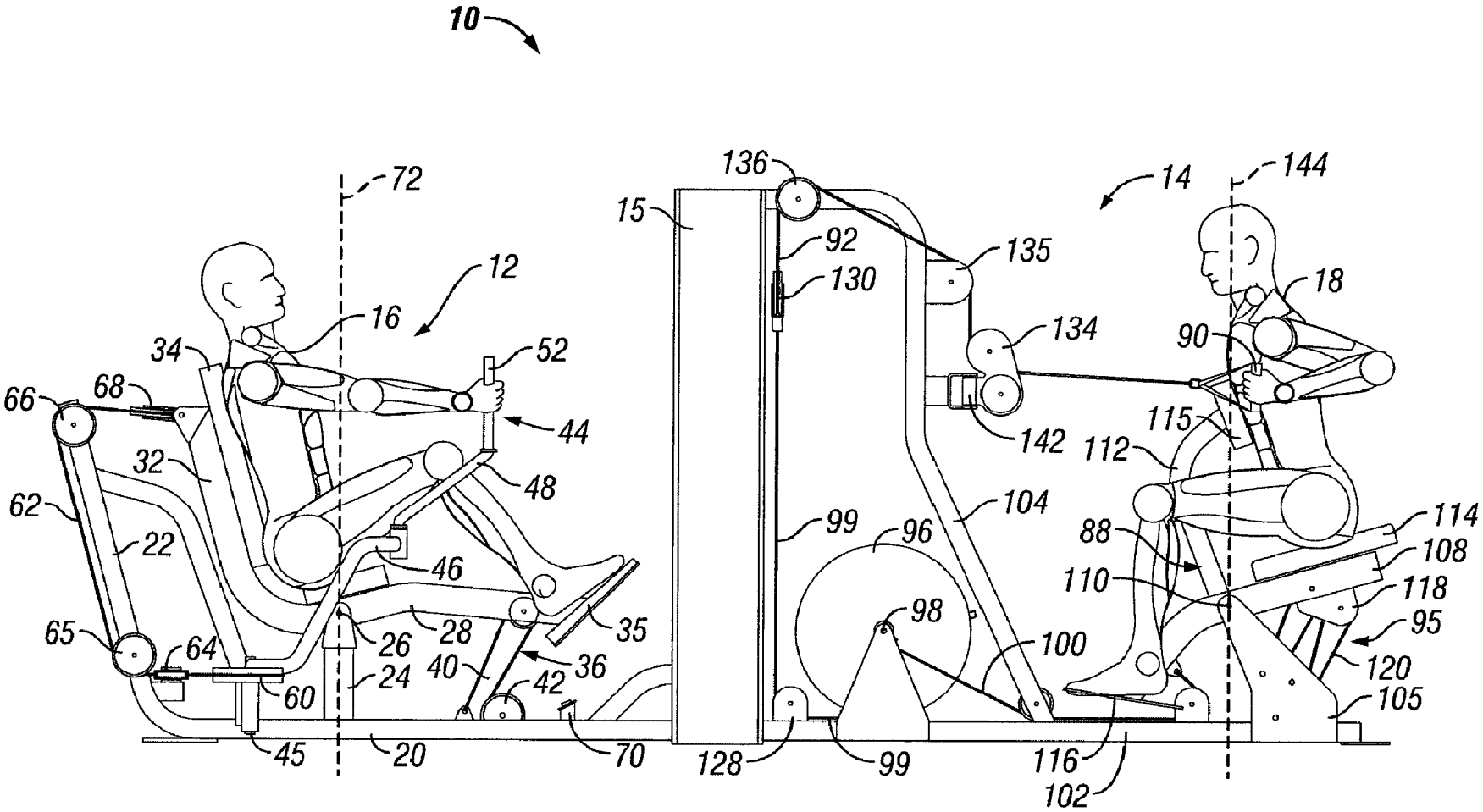
FIG. 2 is a side elevation view similar to FIG. 1, illustrating each station in an exercise end position.
Figure 3A:
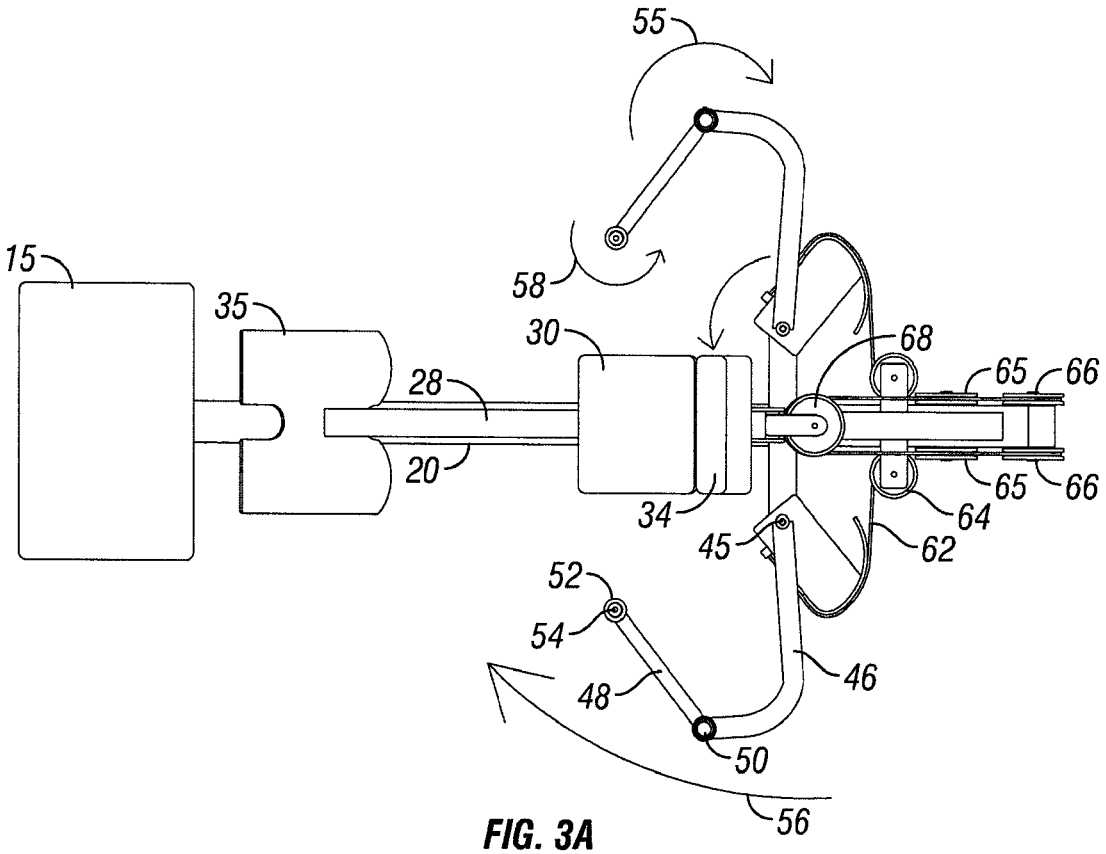
FIG. 3A is a top plan view of the pec fly exercise station of the machine of FIGS. 1 and 2, illustrating the start position of the exercise arms as in FIG. 1.
Figure 3B:
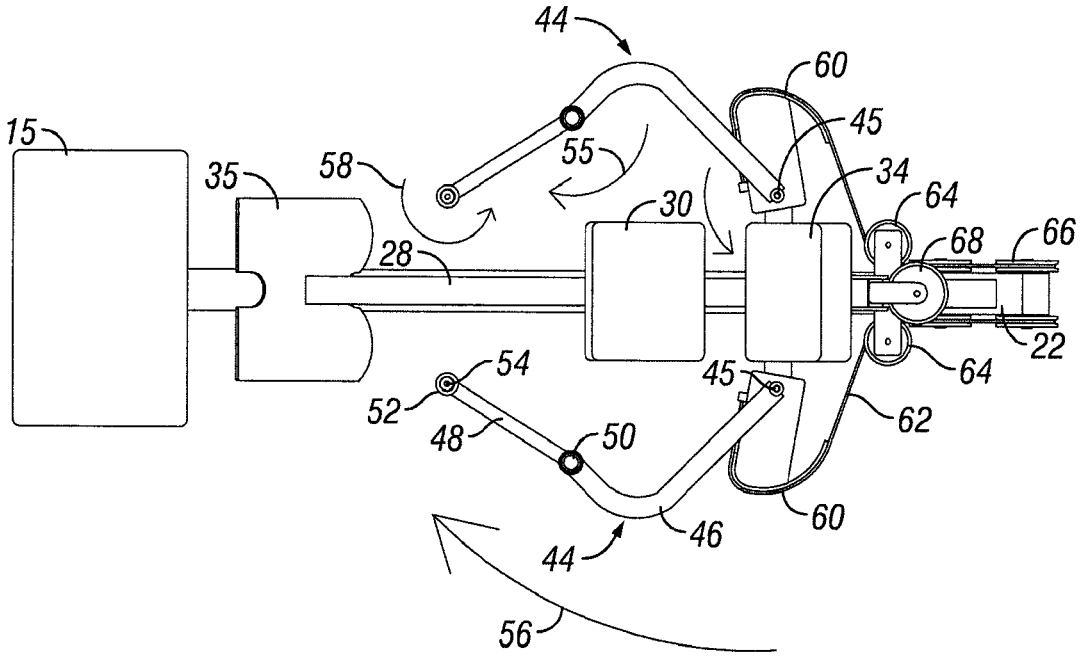
FIG. 3B is a top plan view similar to FIG. 3A, illustrating the end position of the exercise arms as in FIG. 2.
Figure 4:
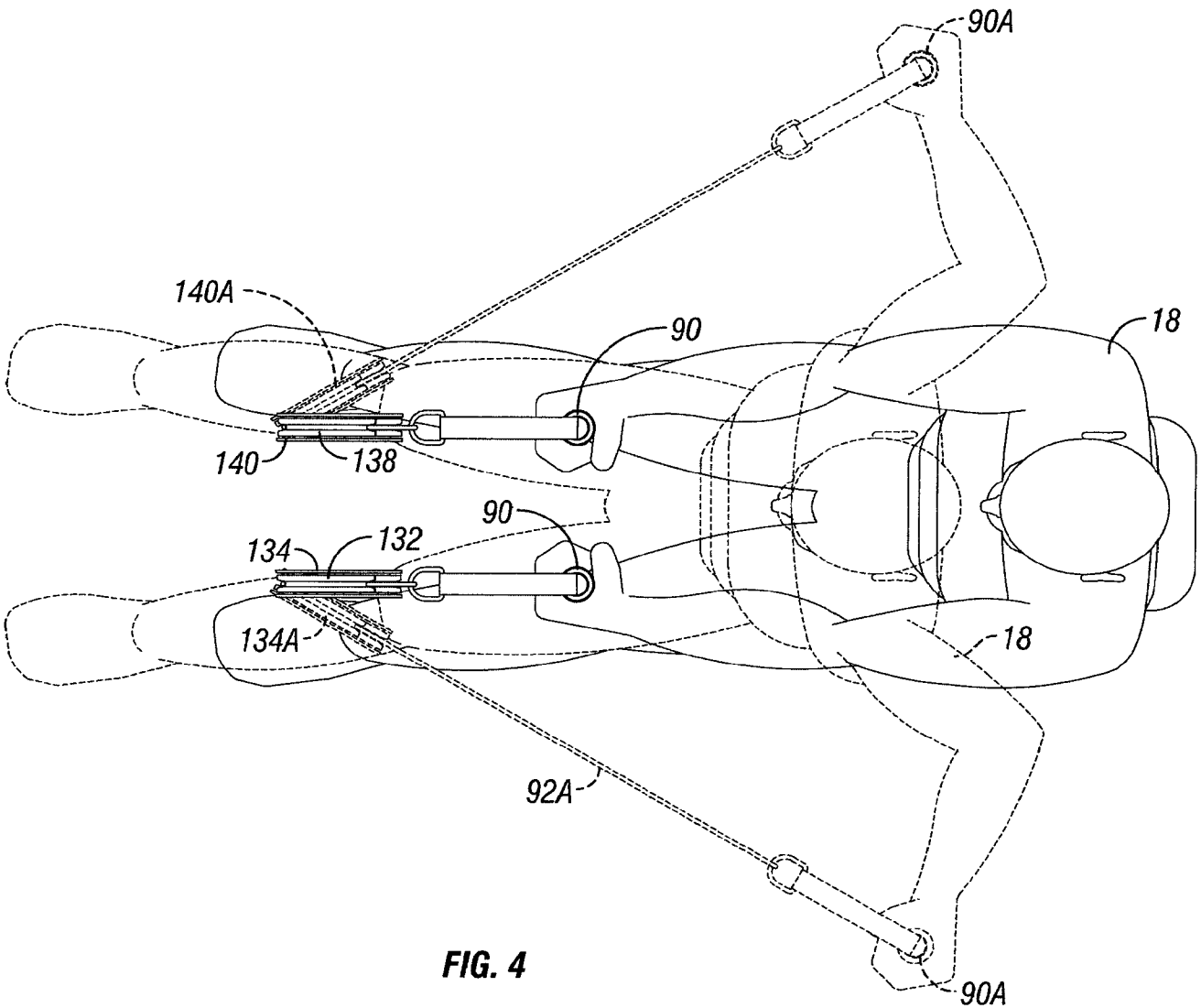
FIG. 4 is a top plan view of the rear deltoid exercise station of the machine of FIGS. 1 and 2, illustrating the exercise arm movement.

FIGS. 1 to 4 illustrate a multi-station exercise machine 10 according to one embodiment, which has a first exercise station 12 for performing pectoral ("pec") fly exercises and a second exercise station 14 for performing rear deltoid exercises. The two stations 12, 14 share a common load or weight stack and are mounted face-to-face on different portions of a main frame assembly with the shared weight stack between them. In this embodiment, the main frame assembly comprises main frame portions of the two exercise stations and a housing 15 for the shared weight stack secured between the main frame portions. FIG. 1 illustrates both stations of the machine in a start position while FIG. 2 illustrates both stations in the finish position, with FIGS. 3 and 4 illustrating the exercise arm movements of each machine, as described in more detail below. FIGS. 1 and 2 illustrate a first user or exerciser 16 seated on the pec fly station in the start and end positions of the pec fly exercise, and a second user or exerciser 18 seated on the rear deltoid station in the start and end positions of the rear deltoid exercise.

Both stations 12, 14 have a pivoting user support and movement of the user engagement device is translated into rocking movement of the user support by a connecting linkage. The pectoral fly ("pec fly") exercise machine 12 is designed for performing pec fly exercises similar to the free weight pectoral fly exercise, but without the disadvantages of a free weight exercise. The pectoral fly machine of this embodiment is designed to combine three pectoral fly exercises in one machine, specifically a straight pec fly, a decline pec fly, and an incline pec fly, as described in more detail below. FIGS. 1 and 3A illustrate the start position of the pec fly station, while FIGS. 2 and 3B illustrate the end position.

The pec fly station 12 has a main frame portion comprising a base section 20, a rear upright 22, and a pivot mounting post 24 on the base section. A generally L shaped user support 25 is pivotally mounted on the pivot mounting post 24 for rotation about pivot axis 26. The user support 25 has a base 28 on which a seat pad 30 is mounted, and an upright 32 on which back pad 34 is mounted, with the base and seat pad comprising a primary user support and the upright and back pad comprising a secondary user support. A foot rest or foot plate 35 is mounted at the forward end of the base 28 and comprises an additional user support. The exercise resistance comprises a selectorized weight stack in housing 15 and is linked to the base of the user support via a cable and pulley linkage 36, only part of which is visible in the drawings. The cable and pulley linkage 36 includes a pulley 38 at the forward end of the base 28 adjacent the foot plate, and a cable 40 extending from an anchor on the base of the main frame, around pulley 38, around a second pulley 42 on the frame base, and then into the weight stack housing to extend around additional guide pulleys before linking to the weight stack in a conventional manner.

A pair of multi-part, articulating exercise arms 44 are rotatably mounted via pivot shafts 45 at their first ends on the base section of the main frame, one on each side of the user support, as best illustrated in FIGS. 3A and 3B. Each exercise arm 44 has a first elongate part 46 having a first end pivoted on pivot shaft 45 and a second end, and an elongated handle arm 48 which has a first end rotatably mounted on the second end of part 46 for rotation about pivot axis 50. A user-engaging grip 52 is rotatably mounted on the second end of handle arm 48 for rotation about pivot axis 54. The pivotal connection between each handle arm and the respective elongate part 46 of the exercise arm allows the handles to rotate inwardly and outwardly about pivot axes 50, as indicated by arrows 55 in FIGS. 3A and 3B, so that the combined movement of the elongate exercise arm and elongated handle about pivots 45 and 50 results in forward and rearward elliptical travel paths (see arrow 56). At the same time, the upwardly extending hand grips 52 rotate about their own axes 54 during an exercise movement, as indicated by arrows 58 in FIGS. 3A and 3B.

A resistance cam 60 is mounted on each pivot shaft 45. A cable or flexible link 62 has a first end attached to a cam 60 of a first exercise arm, and extends over a first series of pulleys 64, 65, 66 mounted on the rear upright of the main frame. Cable 62 then extends around a swivel pulley 68 pivotally mounted at the upper end of the rear upright 32 of the user support frame, and then around a second series of pulleys 66, 65, 64 on the opposite side of the rear upright, before attaching to the cam 60 of the second exercise arm. This cable and pulley assembly provides a connecting link between the user support and exercise arm, and translates forward rotational movement of one or both exercise arms into rearward rotational movement of the user support.

FIG. 1 illustrates a user 16 seated on the user support of the pec fly station 12 in the exercise start position, while FIG. 3A is a plan view of the pec fly station in the same position but without the user. The user sits on the seat in a slightly forwardly inclined position, and places their feet on foot pad 35, which rests on a support post 70 on the base of the frame in the start position. They grab the hand grips 52 and push the hand grips and associated exercise arm forwards into the end position of FIGS. 2 and 3B. In the start position, the user's upper body is inclined forwardly at an orientation of around 3 degrees to a vertical gravitational centerline 72 passing through the user support pivot axis 26. The user's elbows are bent with the arms out to the side and the hands slightly below the shoulders, mimicking the start position of the arms for a free weight pec fly exercise, while the body is forwardly inclined, in position for an incline pectoral fly. Pushing the exercise arms forward causes the cams 60 mounted on the exercise arm pivot shafts to rotate, which pulls both ends of the cable 62 which is reeved around the swivel pulley 68 mounted at the upper end of the user support. This causes the user support 25 to pivot rearward about pivot 26 against the exercise resistance linked to the forward end of the user support. This action moves the user from a forwardly inclined position to a slightly reclined position as illustrated in FIG. 2, ending with their arms extending forward in front of their body, similar to the ending position of the arms for a free weight pec fly exercise, while the body is in a decline pec fly position.

FIGS. 3A and 3B illustrate the movement of the three parts of each articulating exercise arm 44, comprising the first exercise arm portions or parts 46, elongated handle arms 48, and user-engaging grips 52, from the start to the end position of the exercise. The three pivot axes 45, 50, and 54 imitate the joint movement of the shoulder, elbow, and wrist, respectively, when performing a free weight pectoral dumbbell fly exercise.

The user support pivot 26 is positioned directly under the user in this exercise station, and the gravitational centerline 72 of the user support pivotal movement runs very close to the centerline of the user's hip, allowing a balanced portion of the user support and user to be positioned on each side of the line 72 in both the start and end position. Because the user support seat rises upward as it rotates while the exercise arms remain in the same horizontal plane, the positioning of the user's hands, relative to their shoulders, is slightly higher in the start position than the end position. This, coupled with the fact that the user is in all three pectoral fly positions (decline, flat/straight, and incline) during the exercise, allows this exercise machine to combine all three possible pectoral fly exercises in one exercise movement for greater muscle involvement. In the start position, the user is in an incline pectoral fly position, and travels through a flat or straight pec fly position during the exercise, finishing the exercise in a decline pectoral fly position. This produces an enhanced workout which saves time and money, because three machines or exercise stations providing three pec fly exercises are combined into one.

FIG. 1 also illustrates the rear deltoid or upper back exercise station 14 of the multi-station machine in a start position while FIG. 2 illustrates the station 14 in an end position for the exercise, and FIG. 4 illustrates movement of the user's arms in performing a rear deltoid exercise on station 14.

The station 14 has a main frame portion 85 comprising a base section 102 and upright section 104, a user support frame 88 pivotally mounted on the base section 102, a user engagement device comprising user engaging handles 90 attached to opposite ends of a cable or flexible exercise arm member 92 extending around a series of pulleys 134, 135, 136, an exercise resistance comprising the weight stack in housing 15 linked to the user support frame via a cable and pulley assembly 95, and a multiple cam connecting linkage extending from the user engagement device to the user support frame. In this embodiment, the multiple cam linkage comprises a dual cam assembly 96, 98 and first and second cables or flexible links 99, 100 extending between cable 92 and a forward end of the user support frame, as explained in more detail below. The flexible links 99, 100 may comprise any suitable flexible elongate members such as cables, belts, lines, chains and the like.

The main frame portion 85 also has user support pivot mount plates 105 extending upwardly at the rear end of the base section 102, and a pair of cam pivot mounting plates 106 extending upwardly from the base section between the upright section 104 and the weight stack housing 15.

The user support frame 88 is generally T-shaped, with a base 108 pivotally mounted between the upper ends of the pivot mount plates via pivot pin 110, and an upright post 112 extending upwards from base 108 and curving rearward at its upper end. A user support seat pad 114 is mounted on the rear part of the base, while a chest support pad 115 is mounted at the end of post 112. A foot support or footplate 116 is secured to the forward end of the base 108. The rear part of the base 108 is linked to the weight stack via the second cable and pulley assembly 95. As best illustrated in FIG. 2, cable and pulley assembly 95 comprises a set of pulleys mounted between mounting plates 118 on the undersurface of base 108, a set of pulleys (not visible in the drawings) mounted between the pivot mounting plates 105, and a cable 120 extending from an anchor back and forth over the two sets of pulleys, and then running through the base section 102 of the main frame into the weight stack housing where it extends over further pulleys (not visible in the drawings) before linking in any conventional manner with the weight stack.

The forward end of the user support frame is linked to the user engaging handles via the connecting linkage 100, 98, 96, and 99, and the cable 92, as explained in more detail below. The connecting linkage includes the first and second cam portions 96, 98 of different diameter or profile mounted for rotation about a common pivot axis 122 via a common pivot shaft rotatably mounted between the upper ends of cam plates 106. The forward end of the user support base 108 is linked to the first, smaller cam 98 by cable 100 which extends from the cam around a pulley 124 at the lower end of upright 104, around a second pulley 125 on the frame base beneath the user support base, and which is tied off at anchor 126 on the underside of the base 108 close to the footplate 116.

A second cable 99 extends from the second, larger cam 96 around a fixed pulley 128 at the forward end of base 102 and is anchored to the housing of a floating pulley 130. As noted above, the user engagement device in this embodiment comprises the handles 90 and flexible cable 92 which has opposite ends secured to the respective handles 90. Cable 92 extends from one handle between pulleys 132 of one swivel pulley assembly 134 mounted on upright 104, around one of a pair of fixed, side-by-side pulleys 135 on the upright above the swivel pulley assemblies 134, then around one of a pair of parallel pulleys 136 on opposite sides of an upper, generally horizontal portion of the upright 104, and then downwardly around the floating pulley 130. From the pulley 130, cable 92 extends back up around the second one of the pulleys 136, around the second one of the pulleys 135, and is then reeved between the two pulleys 138 in the second swivel pulley assembly 140 (see FIG. 4), before connecting to the second handle 90. With this arrangement, rearward movement of one or both handles pulls up the floating pulley 130, rotating the cams 96 and 98. Cables 99 and 100 are oppositely connected to the respective cam portions 96 and 98 so that pulling on handles 90 unwinds cable 99 from cam portion 96 while winding cable 100 onto cam portion 98, rotating the user support frame upwardly about pivot 110.

The swivel mounts 142 of the two swivel pulley assemblies 134, 140 (only one of which is visible in the drawings) allow the assemblies to pivot in and out as indicated in FIG. 4 as the user moves their hands in an exercise movement which exercises the upper back muscles. In order to perform a rear deltoid exercise, the user 18 first sits on the user support in the position of FIG. 1 and the solid line position of FIG. 4, placing their feet on the footplate 116, their chest against the chest pad 115, and grabs the handles 90 with their arms straight in front of their body, slightly bent, and their hands close together, as indicated in FIG. 1 and in solid lines in FIG. 4. At the start of the exercise, the user is in a slightly reclined orientation at an angle of around 6 degrees to the gravitational centerline or vertical centerline 144 which extends through the user support pivot 110, as indicated in FIG. 1.

From the position illustrated in FIG. 1, the user pulls the handles or hand grips 90 rearward and outward. Since the exercise arm in this embodiment is a flexible cable 92 which extends from each handle between the pulleys of a respective set of swivel pulley assemblies 134, 140 which can swivel inward and outward, the user controls the exercise path and thus the type of upper back exercise performed. In FIGS. 1, 2 and 4, the user is shown performing a rear deltoid exercise in which the user moves their hands rearward and outward into an end position in which the user's arms are bent with their hands positioned out to the sides of their body, as illustrated in the dotted line handle position 90A of FIG. 4. As noted above, this movement also pulls the user support upwardly against the exercise resistance, with the chest pad and user upper body ending up in a forward lean of around 20 degrees from the vertical. The user's arms finish in a bent position with their hands positioned out to the sides, slightly below and forward of their shoulders.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. Additionally, the user can determine the travel path of the user engaging handles or grips 90. These factors together provide an enhanced workout by involving a greater number of muscles than a rear deltoid exercise performed in only one position, thereby combining multiple exercises into one.

Instead of performing a rear deltoid exercise, a user may chose to perform a mid-row type of exercise, pulling their hands back and only slightly outwards. The user may define the travel path of the grips as desired throughout the exercise and may end the exercise with the handles in the position of FIG. 4 or any other desired position so as to perform different upper back exercises.

The gravitational centerline or vertical centerline 144 of the user support pivot axis 110 runs through the exerciser's thigh, just behind the knee in the start position and ending at mid thigh in the finish position of the rear deltoid exercise illustrated in FIG. 2. There is a balanced distribution of weight on each side of the centerline 144 both at the start and end position, minimizing the effect that the weight of the exerciser and user support has on the exercise resistance. The amount of weight positioned on each side of centerline 144 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

The user engagement device of the rear deltoid exercise station of FIGS. 1 to 4 comprises handles attached to a flexible line or cable 92, to provide a unilateral, three dimensional user defined exercise motion. The machine is designed to mimic the natural elliptical movement of the corresponding free weight dumbbell exercise, but is able to combine the effectiveness of multiple exercises by rotating the user from reclined to flat to inclined positions throughout the exercise. The connecting linkage 99, 96, 98, 100 which translates movement of the user engagement device into movement of the user support frame is partially flexible and includes at least two axially spaced cams or cam portions rotatably mounted about the same cam axis 122, arranged so that one cable or flexible link wraps around one of the cam portions while the other unwraps. Pulling on the handles or grips 90 in this station rotates the dual cam assembly in a first direction (clockwise as viewed in FIGS. 1 and 2), unwinding cable 99 from the larger cam 96, while winding a smaller amount of cable 100 onto the smaller cam 98. Cams or separate cam portions of different relative diameters can be selected in order to change the ratio between handle movement and user support frame movement, depending on the desired end position for the user support frame.

The multi-station exercise machine 10 of FIGS. 1 to 4 has two stations 12 and 14 which share a common load or weight stack with a cable running from each user support and linking with the weight stack in a manner known in the art. This arrangement allows only one person to exercise on the machine 10 at a time. Alternatively, each station may be associated with its own weight stack or load, with the weight stack housings secured together between the two exercise stations in place of the single weight stack housing 15. This would allow exercisers to use both stations simultaneously.

Both exercise stations 12, 14 have a pivoting user support and a user engagement device with a flexible connecting linkage which translated movement of the user engagement device into pivoting movement of the user support. Additionally, in both exercise stations, a vertical gravitational center line of the user support pivotal movement extends through the user and user support in the exercise start and end position, with only a small amount of the weight of the user and user support passing through the center line in an exercise, reducing the effect of the weight of the user and user support on the exercise starting resistance, and also reducing resistance drop-off at the end of an exercise.

In both exercise stations, the exercise arms or user engagement devices travel in the opposite direction to the user support, and the user support pivots about a pivot axis on a pivot mount located on the base of the main frame, at a base portion of the user support. The pec fly station has a single connecting link (cable 62) which translates movement of the exercise arms into movement of the user support, while the rear deltoid station has a multiple part connecting linkage of cables and cams. The user support rocks rearward between the exercise start and end positions in the pec fly station, while the user support rocks forward in the rear deltoid station. The user engaging grips or handles travel away from the user in the pec fly station, but travel towards the user in the rear deltoid station. Both stations allow for independent (one arm at a time) exercise movement. Connection of two or more exercise stations in a multi-station arrangement can conserve space in a gym and provide for a more orderly arrangement of exercise stations.

Figure 5:
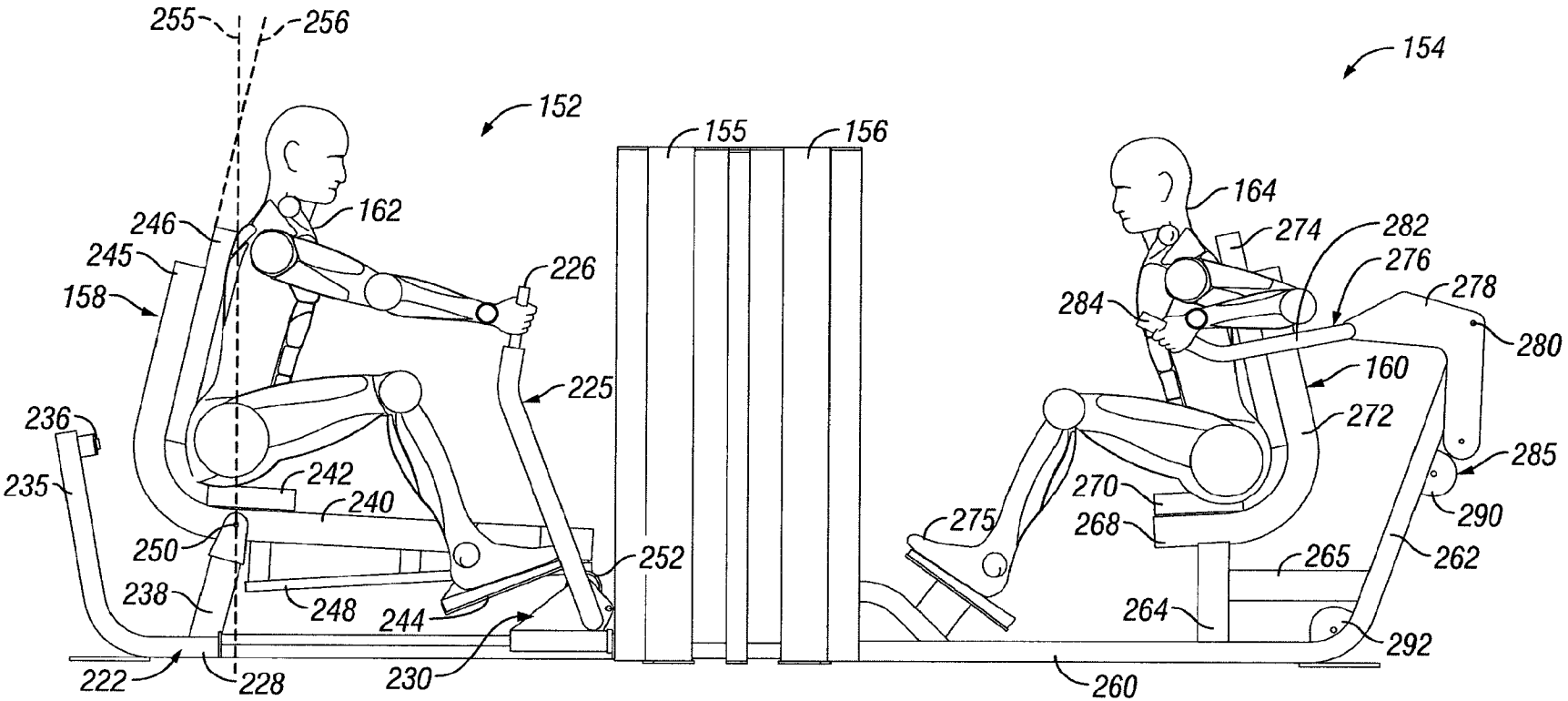
FIG. 5 is a side elevation view of a multi-station exercise machine according to another embodiment, with a user seated on each exercise station of the machine in the start position adopted at the beginning of the exercise.
Figure 6:
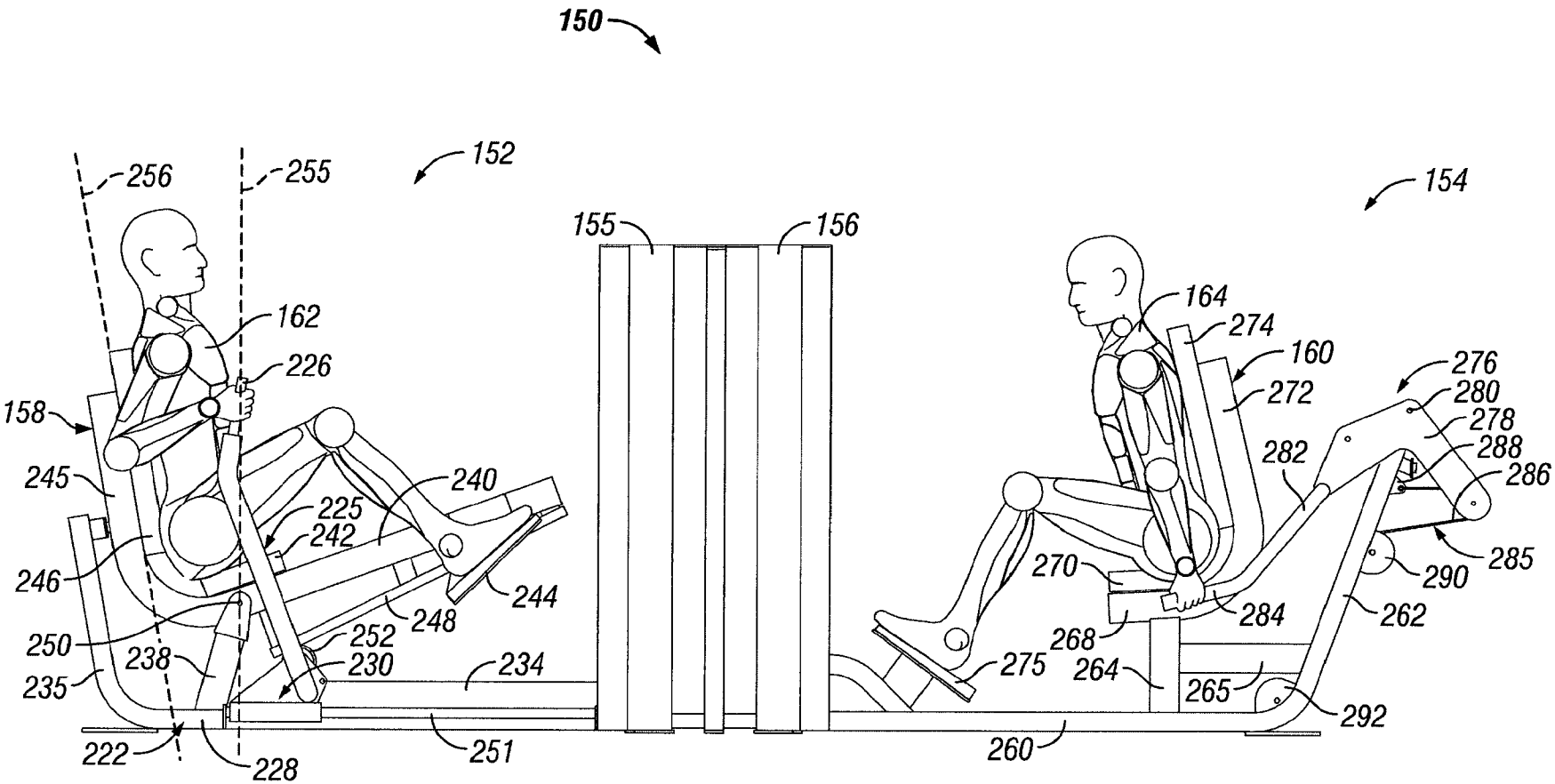
FIG. 6 is a side elevation view of the exercise machine of FIG. 5 with each exercise station in the end position of the exercise.

FIGS. 5 and 6 illustrate another embodiment of a multi-station exercise machine 150 which again has two exercise stations 152, 154, but in this case each station has its own dedicated weight stack in back-to-back weight stack housings 155, 156, respectively. This allows both exercise stations to be in use simultaneously and independently. The first exercise station 152 comprises a seated mid row exercise station with a pivoting user support 158, while the second exercise station 154 comprises a seated dip exercise station which has a fixed user support 160, and the stations are positioned in line and facing one another on opposite sides of the double weight stack 155, 156.

FIG. 5 illustrates each exercise station 152, 154 with a user 162, 164 seated on the respective user support and positioned in a start position for the respective exercise, while FIG. 6 illustrates the end positions of the two exercises. However, the two stations can be used completely independently and a user on one station may be at a different stage in the exercise from a user on the second station.

As noted above, the first exercise station 152 is designed for performing mid-row exercises. Station 152 comprises a main frame portion 222 with user support 158 pivotally mounted on the frame. A U-shaped user engagement device or exercise arm 225 with handles 226 at its free, upper ends is slideably mounted on the base 228 of the frame portion 222 via linear slide or carriage 230. The linear slide 230 is linked to an exercise resistance, in this case a weight stack in housing 155, via a cable and pulley linkage, most of which is concealed within the weight stack housing, with the cable 234 of the linkage connected to the slide 230 as indicated in FIG. 6. The linear slide or sliding wedge 230 is also linked to the underside of the user support 158, as described in more detail below, and forms part of a connecting linkage which translates movement of the exercise arm into movement of the user support. The sliding wedge linkage between the exercise arm and user support is similar to that described in U.S. Pat. No. 6,916,278, the contents of which are incorporated herein by reference.

The main frame portion also has a slightly rearward inclined upright strut 235 at the rear end of base 222, which has a stop pad 236 at its upper end forming a rest for the user support in the exercise end position of FIG. 6, and a pivot mounting post 238 extending upwardly from the base at a position spaced forward from upright strut 235. The user support 158 is generally L-shaped, and has a base 240 on which a seat pad 242 is mounted, with a pair of foot rests or foot plates 244 secured adjacent the forward end of base 240, and an upright 245 supporting back pad 246. A guide bar or track 248 is mounted on the underside of the base 240 of the user support so as to extend at an upwardly inclined angle from the rear end to the forward end. The user support is pivoted to the upper end of pivot mount 238 for rotation about pivot axis 250 located beneath the seat pad 242.

The linear slide or wedge 230 has a lower sleeve portion which is slideably engaged on a pair of parallel, linear guide bars 251 on the base 228 of the frame, and an upper wedge shaped portion comprising spaced parallel plates with a wheel 252 rotatably mounted between the plates at its upper end for rolling engagement on the guide bar or track 248 on the underside of the user support base. The central portion of the U-shaped exercise arm 225 is rigidly mounted on the slide or wedge 230. Rearward linear motion of the exercise arm is translated into rearward rotational movement of the user support with this arrangement, as described in more detail below.

FIGS. 5 and 6 illustrate a user 162 performing a rowing type of exercise, also known as a mid row exercise, on the station 152. In FIGS. 5 and 6, dotted line 255 is the gravitational centerline of the user support pivot 250, while dotted line 256 represents the orientation of the user support back rest, or the back of the user when seated on the support. To perform the exercise, the user sits on the seat with the user support in the position illustrated in FIG. 5, and places their feet on the foot support plates 244 while gripping handles 226 with their arms straight out in front. The user support is initially positioned in a back supported, forwardly inclined position, so that the user's body is initially at a forward lean of around 13 degrees off vertical. The user's arms extend straight forwards with their hands slightly below shoulder level, which is similar to the starting position for a free rowing exercise.

The user then pulls handles 226 towards their body in a rowing action, simultaneously pulling the slide or wedge 230 along the rails 251. This wedges the wheel 252 along the angled user support guide bar 248, rotating the user support rearward about pivot 250, and moving the user from a slightly forwardly inclined position to a reclined position, ending with their arms pulled back and their hands at a slightly lower elevation, relative to their shoulders, than the starting position, as seen in FIG. 6. This follows a natural rearward arcing rowing motion. This exercise machine mimics the slight, naturally arcing movement of the upper body when rowing a boat or exercising on a rowing machine, without allowing the user to bend at the waist, which is undesirable and can occur with a free rowing exercise.

In the mid-row station 152 of this embodiment, the user support pivot 250 is positioned directly under the exerciser. The gravitational centerline 255 runs very close to the centerline of the user's hip, allowing a balanced portion of the user and user support to be positioned on each side of the gravitational centerline in both the start and finish position. Because the user support seat 242 rises upward as it rotates and the exercise arm travels in a straight line, the positioning of the exerciser's hands, relative to their shoulders, is slightly higher in the starting position than the finish position, and the user support travels through three different position during the exercise, moving from an inclined position through a vertical position into a reclined position at the end of the exercise. This involves more of the back muscles in one exercise, which is not possible with a conventional rowing machine exercise using a cable.

The seated dip exercise station 154 is similar to the stand-alone seated dip machine of FIGS. 5 to 8 of co-pending U.S. patent application Ser. No. 10/633,805, the entire contents of which are incorporated herein by reference, except for the fact that the user support 160 in station 154 is fixed, not pivotally mounted.

Station 154 has a main frame portion comprising a horizontal base 260 with a rearwardly and upwardly inclined upright strut 262 at its rear end and an upright seat support strut 264 located in front of strut 262 and connected to it via brace 265. Weight stack housing 156 is connected at the forward end of base 260. The housing contains a conventional selectorized weight stack. The generally L-shaped user support frame 160 is secured to the upper end of seat support strut 264. The user support frame 160 has a first or base portion 268 on which a seat pad 270 is mounted, and a second or upright portion 272 on which a back pad 274 is mounted. The user support frame is fixed at a slight forward inclination, as illustrated. A foot rest or footplate 275 is mounted on the base of the frame, rather than on the user support frame, at a position in front of the forward end of the base portion 260, such that a user can easily rest their feet on the footplate when seated on the seat pad 270 in a forward lean.

An exercise arm assembly or user engagement device 276 is pivotally mounted at the upper end of the upright strut 262 so as to extend forwardly on opposite sides of the user support frame. Arm assembly 276 has a pair of parallel plates 278 pivotally mounted on opposite sides of upright strut 262 via a pivot pin for rotation about pivot axis 280. A U-shaped exercise arm has a central section secured to plates 278, and opposite arms 282 projecting forwardly from plates 278 on opposite sides of the user support frame, with user engaging portions or hand grips 284 at the forward ends of arms 282.

The plates 278 extend rearward from upright strut 262 and are linked to the weight stack at their rear ends via a cable and pulley assembly 285 having a cable 286 extending from an anchor 288 on the rear of strut 262, around a pulley mounted between the rear ends of the plates, then around pulleys 290, 292 on the main frame before running through the base section 260 of the main frame into the weight stack housing where it extends over further pulleys (not visible in the drawings) before linking in any conventional manner with the weight stack.

FIGS. 5 and 6 illustrate the user 164 performing a bar dip type of exercise, with FIG. 5 illustrating the starting position and FIG. 6 illustrating the finish position. In a free bar dip exercise, a user grips two parallel bars on opposite sides of their body. They then pull themselves into a position in which their arms and knees are bent while leaning slightly forwardly for balance. In the starting position of a dip exercise on station 154 of this embodiment, the user 164 sits on the seat and places their feet on the footplate 275, and grabs the handles 284 on each side, as illustrated in FIG. 5. The fixed user support places the user into a slightly forwardly inclined position, with their hands slightly below their shoulders and their arms and legs bent. This closely mimics the starting position of a free bar dip exercise.

The user 164 then pushes the exercise arm assembly 276 downwards about pivot axis 280 until their arms are straight down and aligned with the sides of their body, as indicated in FIG. 6. Pushing the handles of the exercise arm down causes the rear ends of plates 278 to raise, pulling on the weight bearing cable 286 and providing exercise resistance. The exercise ends with the user's arms extending straight down the side centerline of their body in the finish position. Because the user is fully supported and not suspended, as they would be in a free bar exercise, the handles 284 can be angled to provide a more comfortable starting and finishing hand position with less extreme bending to the wrist than would be encountered in a free bar dip exercise.

Figure 7:
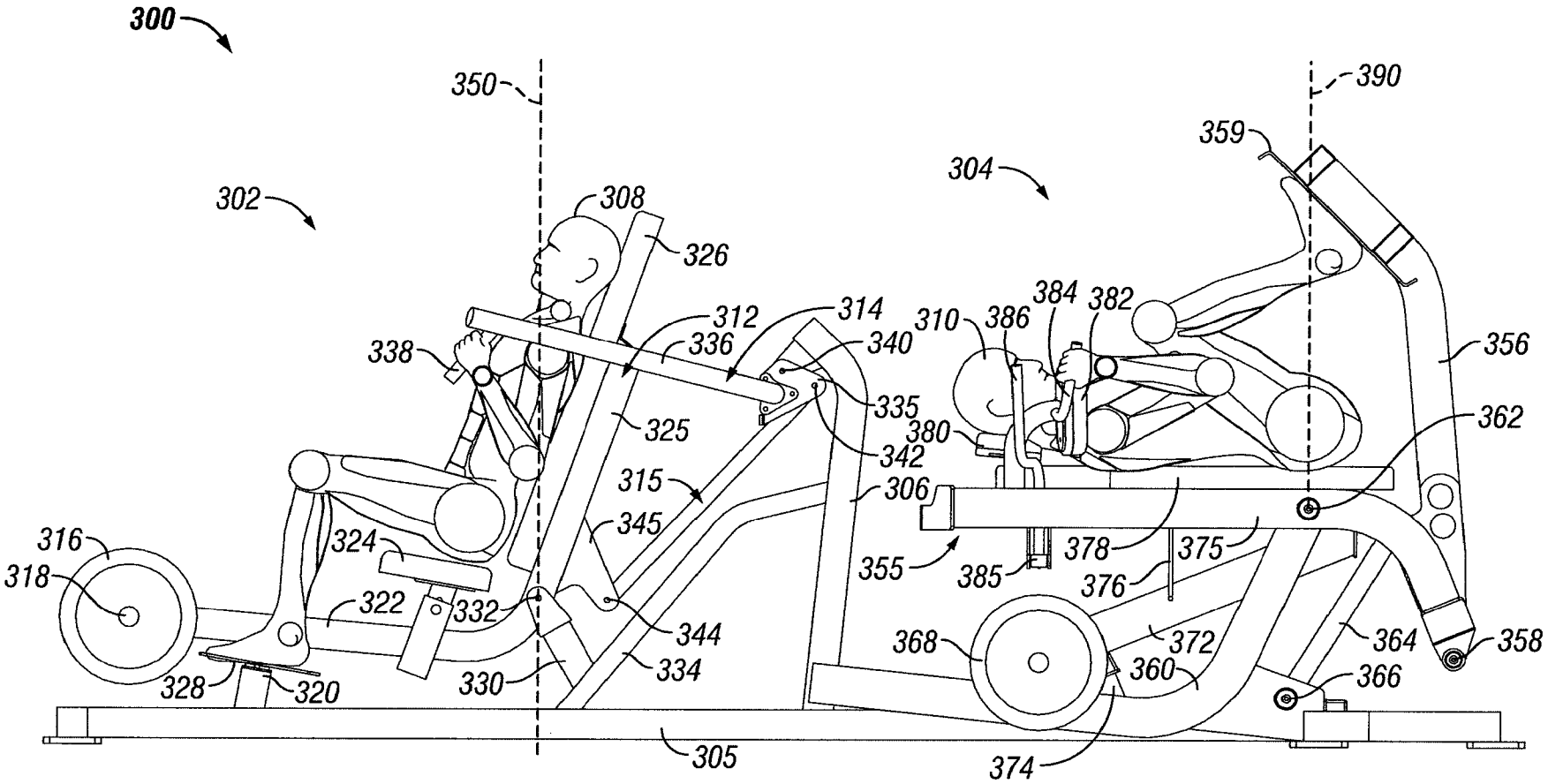
FIG. 7 is a side elevation view of a two station exercise machine according to another embodiment, with a user seated on each station of the machine in the start position adopted at the beginning of the exercise.
Figure 8:
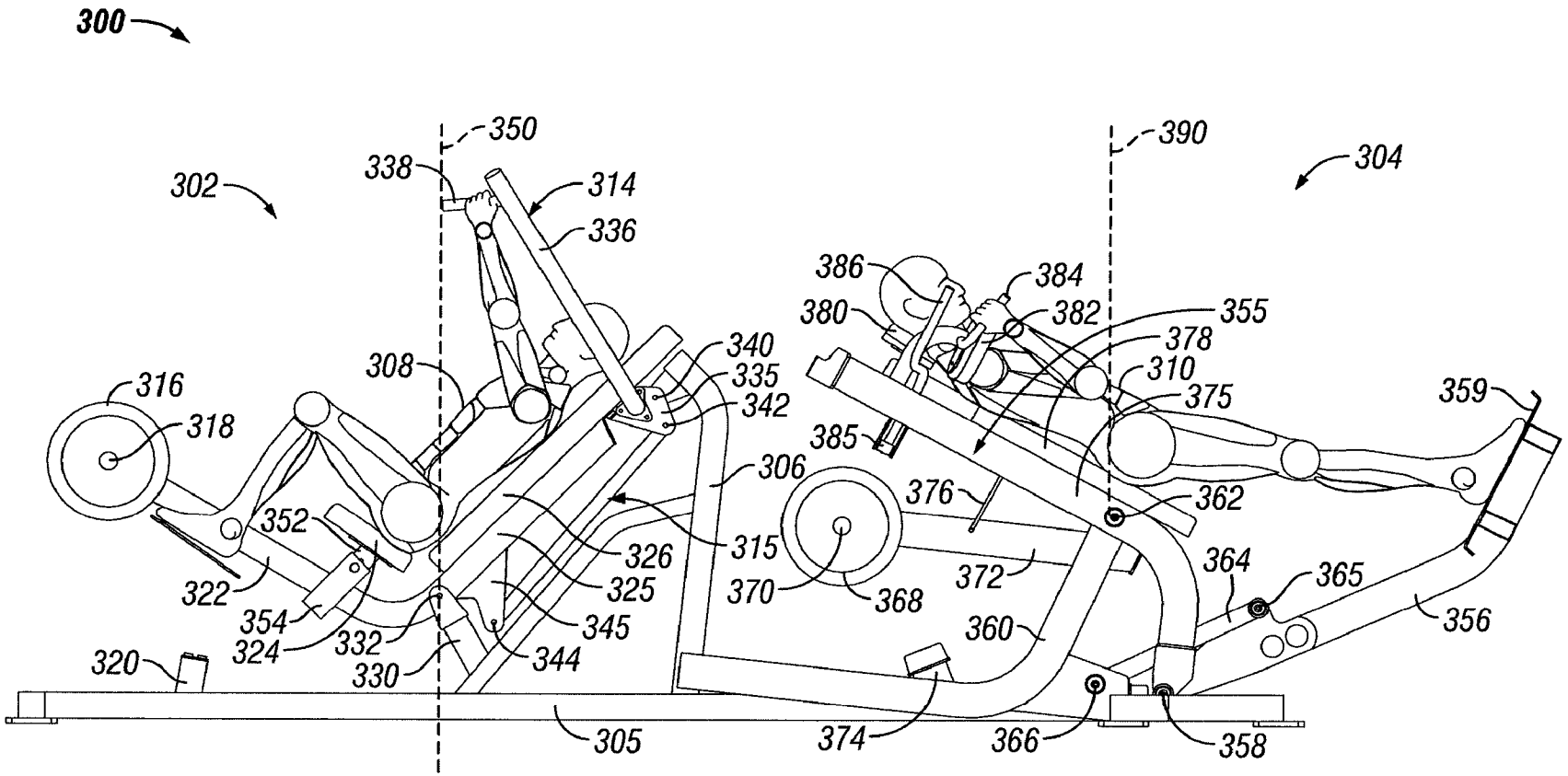
FIG. 8 is a side elevation view of the exercise machine of FIG. 7 with each station of the machine in the end position of the associated exercise.

FIGS. 7 and 8 illustrate a multi-station exercise machine 300 which combines two plate-loaded exercise stations 302, 304 positioned back-to-back. In this embodiment, both exercise stations have rocking seats with user engagement devices and a connecting linkage which translates movement of the user engagement device to movement of the rocking seat. The first station 302 is a chest press exercise station and the second station 304 is a leg press station, but other plate loaded exercise stations may be positioned back-to-back in a similar manner in alternative embodiments. The stations have separate loads or exercise resistance, and can be in use simultaneously and independent from one another, as in the previous embodiment.

The two stations 302, 304 have main frame assembly with a common base portion 305 supporting both stations and having an upright strut 306 located between the two stations. Each station is shown with a user 308, 310, respectively, positioned on the station, with the exercise start position illustrated in FIG. 7 and an exercise end position illustrated in FIG. 8.

Chest press station 302 may be used to perform a bench press type exercise similar to a free weight barbell bench press. The chest press station 302 of this embodiment is the same as the stand-alone chest press machine illustrated in FIGS. 13 to 16 of application Ser. No. 10/633,805 cited above, the contents of which are incorporated herein by reference, apart from the fact that the station shares a common main frame with one or more additional exercise stations. Chest press station 302 duplicates the movement carried out by an exerciser when performing a chest press or bench press with a free barbell or dumbbell, but is easier and more comfortable since the user's movement is guided while the user's body is filly supported throughout the exercise.

Chest press station 302 of this embodiment has a user support frame 312 pivotally mounted on the main frame, a user engagement device or exercise arm assembly 314 pivotally mounted at the upper end of upright 306 of the main frame, a connecting link 315 between the exercise arm and the user support frame, and an exercise resistance, which in this case comprises weight plates 316 mounted on weight receiving pegs 318 at the forward end of the user support frame. A stop post 320 on the base portion 305 of the main frame supports the user support frame in the start position.

The user support frame 312 is generally L-shaped with a base 322 on which a seat pad 324 is adjustably mounted, and an upright 325 on which a back pad 326 is mounted. A footrest or foot plate 328 is secured beneath the base at an appropriate position and orientation for supporting the feet of a user seated on the seat pad. The weight plates 316 are positioned forward of the footrest 328. The frame 312 is pivotally supported on a pivot mount 330 on the main frame for rotation about pivot axis 332 which is located on the upright 325 of the user support frame adjacent the junction between the upright and base 322 of the frame. Pivot mount 330 is supported on a brace member 334 which extends between the base 305 and upright strut 306 of the main frame.

The exercise arm exercise arm assembly 314 comprises a U-shaped member with a central section secured to pivot bracket or pivot plates 335 which are pivoted to the upper end of the upright 306 and to the upper end of connecting link 315, as described below. Opposite exercise arms or arm portions 336 of the U-shaped member extend on opposite sides of the user support. A pair of downwardly directed handles 338 are mounted at the forward ends of arms 336 for gripping by a user with their hands in a suitable orientation for performing a chest press exercise. Pivot bracket 335 is pivoted at one position to the upper end of upright 306 via pivot 340, and at another position to the upper end of connecting link 315, via pivot 342. The lower end of the connecting link is pivoted via pivot 344 to a pivot bracket 345 at the lower end of the user support upright 325, so that upward rotational movement of the exercise arm results in rearward rotational movement of the user support.

In an alternative arrangement, a single or two-part exercise arm may be adjustable in order to vary the start position for user's with different arm lengths. The bracket or plate 335 may be replaced with one or two range-of-motion or ROM plates, and each exercise arm may be releasably secured to the ROM plate, at a selected angular position. In this case, the arm is pivoted to the ROM plate, which has a series of spaced openings extending in a part circular path. The arm is secured at a selected angular orientation relative to the plate by a releasable push pin or the like extending through a selected opening. A ROM arrangement for an adjustable exercise arm is described, for example, in U.S. Pat. No. 6,090,020 of Webber, the contents of which are incorporated herein by reference.

The user 308 first sits on the seat 324 in the start position of FIG. 7, resting their feet on footrest 328 which rests on stop member 320 in the start position, and grabbing the handles 338 with their hands. The user starts the exercise in a slightly reclined position, with their hands slightly below their shoulders and slightly in front of, and in line with, their chest. This mimics the start position for a barbell bench press. Pushing the exercise arm forwards into the position of FIG. 8 pushes the connecting link 315 downward, which in turn pushes the user support, causing it to rotate rearward about its pivotal connection 332 to the main frame. The exercise arm and user are rotated during the exercise to produce an exercise path with approximately 10 degrees of arc. This moves the user from a slightly reclined position to a substantially reclined position, ending with their arms extending straight forward and their hands at a slightly higher position relative to their shoulders, as compared with the start position. As indicated in FIG. 8, the user's arms in the end position are angled slightly upwardly with respect to a line perpendicular to the back pad 326. This end position mimics the end position for a free barbell bench press, and substantially mimics the slight, natural arcing movement the arms go through in the "chest to chin" movement of a free barbell bench press.

In the chest press station 302 of FIGS. 7 and 8, the connecting link 315 pushes the user support to cause it to rotate rearward. The vertical dotted line 350 in FIGS. 7 and 8 indicates the vertical gravitational centerline of the user support pivot axis 332, which is the gravitational centerline of the user performing the exercise. The position of pivot axis 332 places the centerline 350 rearward of the user's hips and in line with the user's shoulders in the start position of FIG. 6. Thus, the majority of the user starts the exercise in a position forward of the centerline 350, and the user's body rotates rearwardly through the centerline throughout the exercise, finishing with the centerline 350 extending through their torso for a more evenly balanced weight distribution at the end of the exercise. The combined movement of the user support and exercise arm produces around a ten degree rise in hand position from start position, which is similar to the natural arcing pattern of the free barbell bench press exercise, which has the bar traveling in a "chest to chin" exercise motion. At the same time, the exercise station is more comfortable and easier for an inexperienced exerciser, guiding the user throughout the movement to follow the desired exercise path.

In the chest press exercise station 302, the seat pad 324 comprises a primary user support which is adjustable via post 352 which is telescopically engaged in tube 354 mounted on the base 322 of the user support frame. Post is secured in a selected position in tube 354 via a pop pin or lock device, depending on the seat height desired by the user. The back pad 326 comprises a secondary user support, and the foot plate 328 provides an additional user support which travels with the user support frame during an exercise movement. This station has a single, rigid connecting link 315 which translates movement of the pivotally mounted exercise arm into movement of the user support, and the exercise arm and user support both travel in the same direction, rearward about their respective pivot axes.

The leg press station 304 of machine 300 is designed for performing squat type leg press exercises with the user in a prone or supine position at the start of the exercise, as illustrated in FIG. 7. FIG. 8 illustrates the end position of the exercise, with the user's torso inclined upwardly relative to the start position of FIG. 7. The leg press station is similar to the stand alone leg press machine of FIGS. 21 to 24 of co-pending application Ser. No. 10/633,805 referenced above, the contents of which are incorporated herein by reference, except that the weight stack is replaced by hand loaded weight plates, as described in more detail below.

Leg press station 304 has a user support frame 355 pivotally mounted on the main frame, and a leg exercise arm 356 which has a lower end pivoted to a downwardly directed portion at the forward end of the user support frame 355 for rotation about a first pivot axis or first pivot connection 358. The leg exercise arm has a user engaging foot plate 359 at its upper end. An upwardly inclined pivot mount portion 360 is mounted on the base 305 of the main frame, and the user support frame is pivotally connected to an upper end of the pivot mount portion 360 for rotation about a second pivot axis 362. A connecting linkage 364 is pivotally connected to the exercise arm 356 at a location spaced above first pivot axis 358 for rotation about a third pivot axis 365 (see FIG. 8), and is pivotally connected to the base portion 305 of the main frame for rotation about a fourth pivot axis 366, so that forward rotational movement of the arm 356 results in upward rotational movement of the user support. In the illustrated embodiment, the connecting linkage is a single rigid link, but it may comprise more than one part in alternative embodiments.

The user support frame 355 is generally Y-shaped, with an upper support member 375 and a lower support or strut 372 extending rearward at an angle to the upper member. The upper support member 375 has a downwardly curved portion at its forward end which is pivotally secured to the lower end of the exercise arm at pivot axis 358, as described above. A brace 376 extends between the upper and lower supports 375, 372 at an intermediate point in their length for added support. The exercise resistance in this embodiment comprises weight plates 368 mounted on pegs 370 at the end of the lower support strut 372. Other moving parts of the machine may be linked to the exercise resistance in alternative embodiments, and other types of exercise resistance may be used in place of the weight plates. A support post or stop 374 on the base section of the frame beneath the user support frame engages the lower support strut 372 in the exercise start position, as illustrated in FIG. 7, so as to provide a stop for the user support frame before the user commences an exercise.

A primary support back pad 378 is mounted on the upper support 375 of the user support frame. A secondary support assembly comprising head rest 380, two shoulder pads 382, and two hand grips 384, is mounted at the rear end of the upper support. A user reclining on the back pad can place their feet on foot plate 359, as indicated in FIGS. 7 and 8. The connecting linkage 364 is located beneath the user engaging part of the user support in at least the start position of a leg press exercise, as seen in FIG. 7.

The secondary support assembly is adjustably mounted on the upper support via sliding mount, and secured in a selected position via a spring loaded pull pin 385. Handle 386 is provided for adjusting the position of the secondary support assembly. This permits the spacing between the secondary support assembly and foot plate 359 to be adjusted for users with different leg lengths.

FIGS. 7 and 8 illustrate a user 310 performing a squat type or lying leg press exercise on the station 304. The user first lies on the back pad with the machine in the start position of FIG. 7, with their shoulders braced against the shoulder pads 382, and places their feet on the foot plate 359, adjusting the position of the secondary support assembly if needed. They then push the foot plate 359 forward. While performing the exercise, the user may also grab the handles 384 for added stability. The starting position of FIG. 7 places the user in a substantially horizontal, back supported position with their legs bent, thighs against the torso, and knees aligned with the toes. This corresponds to the squatted position of a free barbell squat exercise, without the difficulty in balance and coordination in reaching this position when standing. The vertical dotted line 390 in FIGS. 7 and 8 represents the vertical centerline extending through the user support pivot axis 362, which is also the gravitational centerline of the user performing the exercise.

As indicated in FIG. 7, the user support backrest 378 starts at an angle of around 90 degrees to the vertical centerline 390, i.e. in a horizontal or substantially horizontal orientation.

When the exercise arm 356 is pushed forward by the user pushing against the foot plate 356, rotating about pivot axis 358, the connecting link 364 pulls the pivot connection point between the exercise arm and user support at pivot axis 358 downward and rearward, which in turn forces the user support 355 to rotate about pivot axis 362 in the same direction as the exercise arm. This also moves the user from a horizontal to an upwardly inclined orientation, with their legs straight out and slightly angled to the upper torso, and resistive force directed up the legs to the hips. This is similar to the standing position of a standing squat exercise, but with the slight angle of the user's torso taking pressure off the lower back. This exercise therefore closely mimics the movement of a standing squat type exercise, but reduces the risk of strain to the exerciser's lower back, since the resistive force directed to the hips and the back is properly supported. This eliminates or reduces spinal compression and improper lower back arching, providing a safer, more comfortable exercise.

The connecting linkage joins the exercise arm to the main frame, and the exercise arm is pivotally mounted on the user support. Thus the exercise arm is mounted to, and travels with, the user support. However, it is still directly linked to the main frame via the connecting link. This linkage connection controls the movement of the exercise arm and ultimately the movement of the user support, maintaining the automatic and continuous adjustment and alignment between the user support and exercise arm.

The user support pivot 362 is positioned directly under the exerciser and the gravitational centerline 390 extending through pivot 362 runs very close to the centerline of the user's hips in the start position of FIG. 7, allowing a balanced portion of both the user support and exerciser to be positioned on each side of the gravitational centerline. At the end of the exercise, the user is raised to approximately 61 degrees to the vertical with a portion of the weight of the user support and user on opposite sides of vertical gravitational center line. As illustrated in FIGS. 7 and 8, a substantial portion of the combined weight of the user and the user support frame is positioned on each side of the gravitational center line 390 of the user support pivot axis in both the start and end position. The combined weight of the user and user support has a reduced effect on the amount of starting resistance, since part of the weight of the user and the user support is rearward of the user support pivot in the start position, acting as a counterbalance to the exercise arm. Because only a portion of the user and user support frame passes through the gravitational center line 390 during the exercise, a major drop off in resistance is not felt by the user during the exercise.

In the exercise station 304, the exercise arm is pivoted directly to the user support and the connecting linkage pivotally links the exercise arm to the frame such that rotational movement of the arm results in rotational movement of the user support. The user support has a primary user support or back pad 378, a secondary user support (head support pad and shoulder pads), and an additional user support comprising hand grips 384, all of which remain in the same relative positions throughout the exercise movement.

In each of the exercise stations 302 and 304 of FIGS. 7 and 8, a connecting linkage translates movement of the user engagement device to the user support. The connecting linkage may be movably engaged with at least two of the main frame, user engagement device, and user support. Additionally, the exercise resistance in both stations is provided by hand loaded plates. In each station, at least one user support portion is adjustable, with the seat pad 324 being adjustable in the chest press station 302, and the shoulder pads of the secondary support being adjustable in the leg press station 304. In both cases, the connecting link is a single, rigid connecting link, although multi-part connecting linkages may be provided in alternative embodiments. In both stations, the exercise arm travels in the same direction as the user support, specifically rearward in the chest press station and forward in the leg press station.

Figure 9:
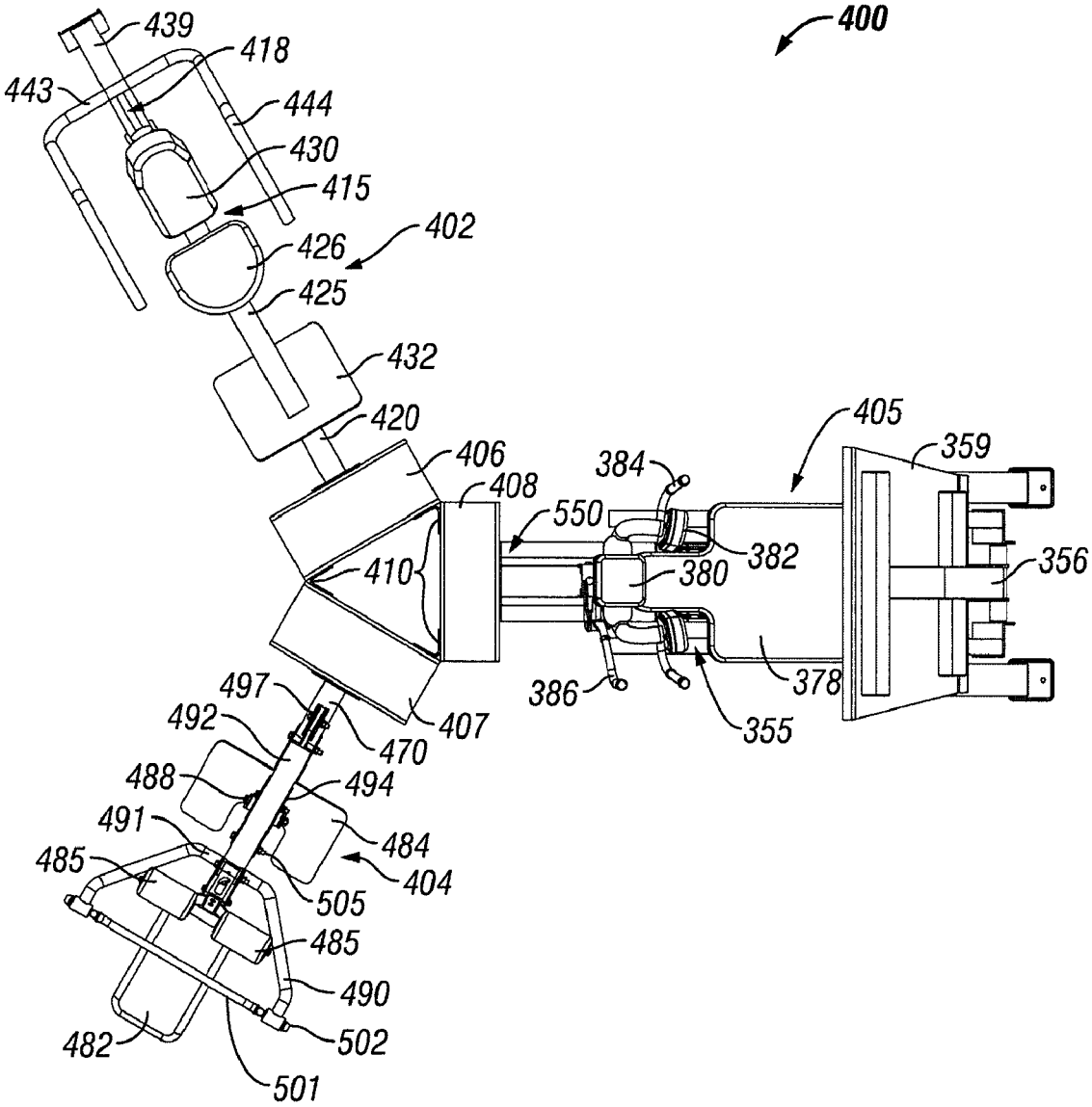
FIG. 9 is a top plan view of another embodiment of a multi-station exercise machine which has three exercise stations.

FIGS. 9 to 15 illustrate another embodiment of a multi-station exercise machine 400, in which three exercise stations 402, 404, and 405 each associated with its own weight stack housing 406, 407, and 408, respectively. The weight stack housings are secured together by angle brackets 410 between the weight stack housings, as illustrated in FIG. 9. The main frame assembly in this embodiment comprises the weight stack housings 406, 407, and 408 and separate main frame portions 420, 470, and 550 supporting the components of the respective exercise stations, as described in more detail below. In this embodiment, the stations comprise a shoulder press exercise station 402, a chin up exercise station 404, and a leg press exercise station 405, although different exercise stations from co-pending application Ser. No. 10/633,805 referenced above may be used in place of stations 402, 404 and 405 in alternative embodiments. The leg press station 405 is substantially identical to the leg press station 304 of the previous embodiment, and like reference numerals are used for like parts as appropriate. However, unlike leg press station 304, the exercise resistance in this embodiment is provided by a weight stack in housing 408.

Figure 10:
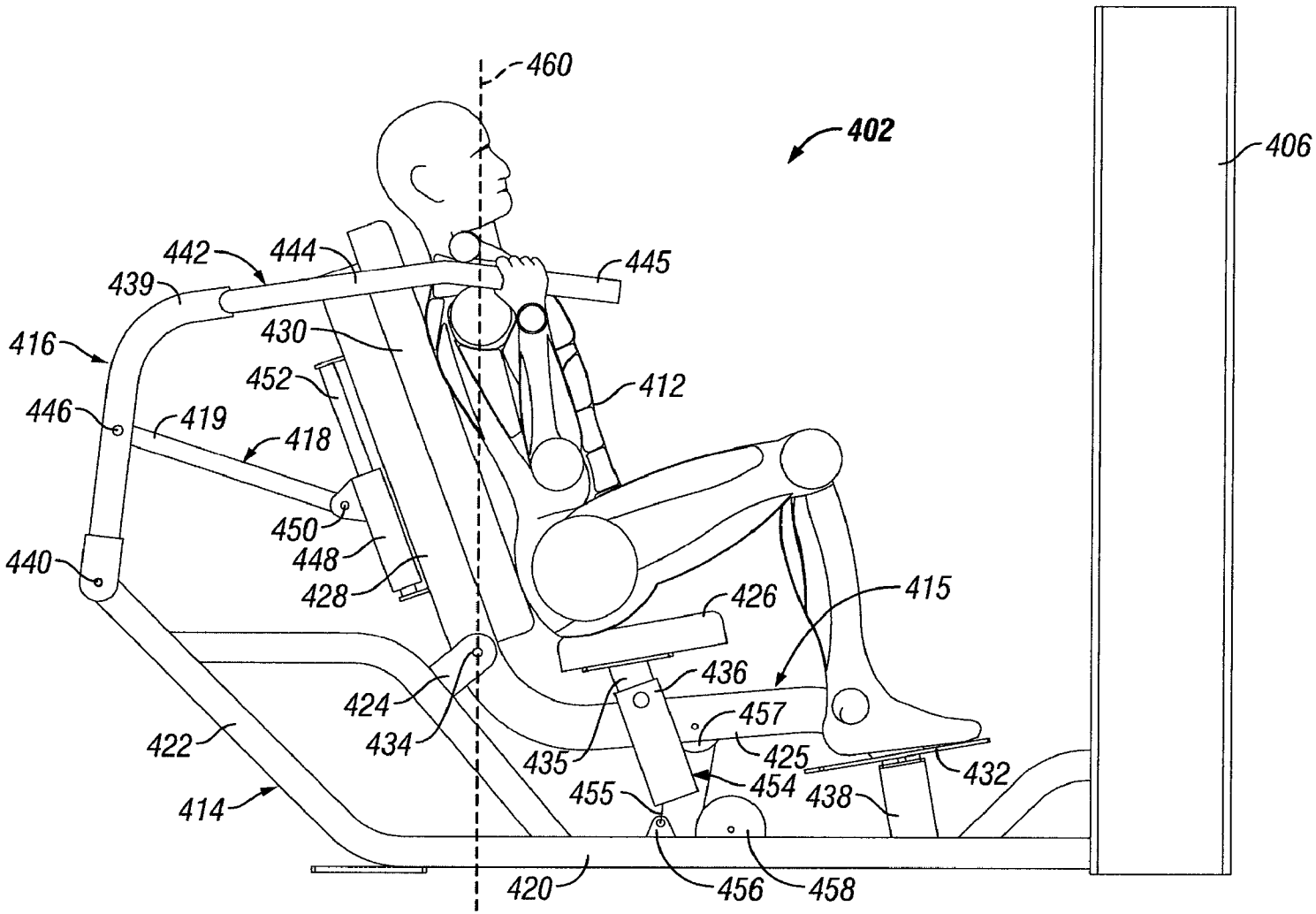
FIG. 10 is a side elevation view of the shoulder press exercise station of the machine of FIG. 9 with a user seated on the user support in the start position of a shoulder press exercise.
Figure 11:
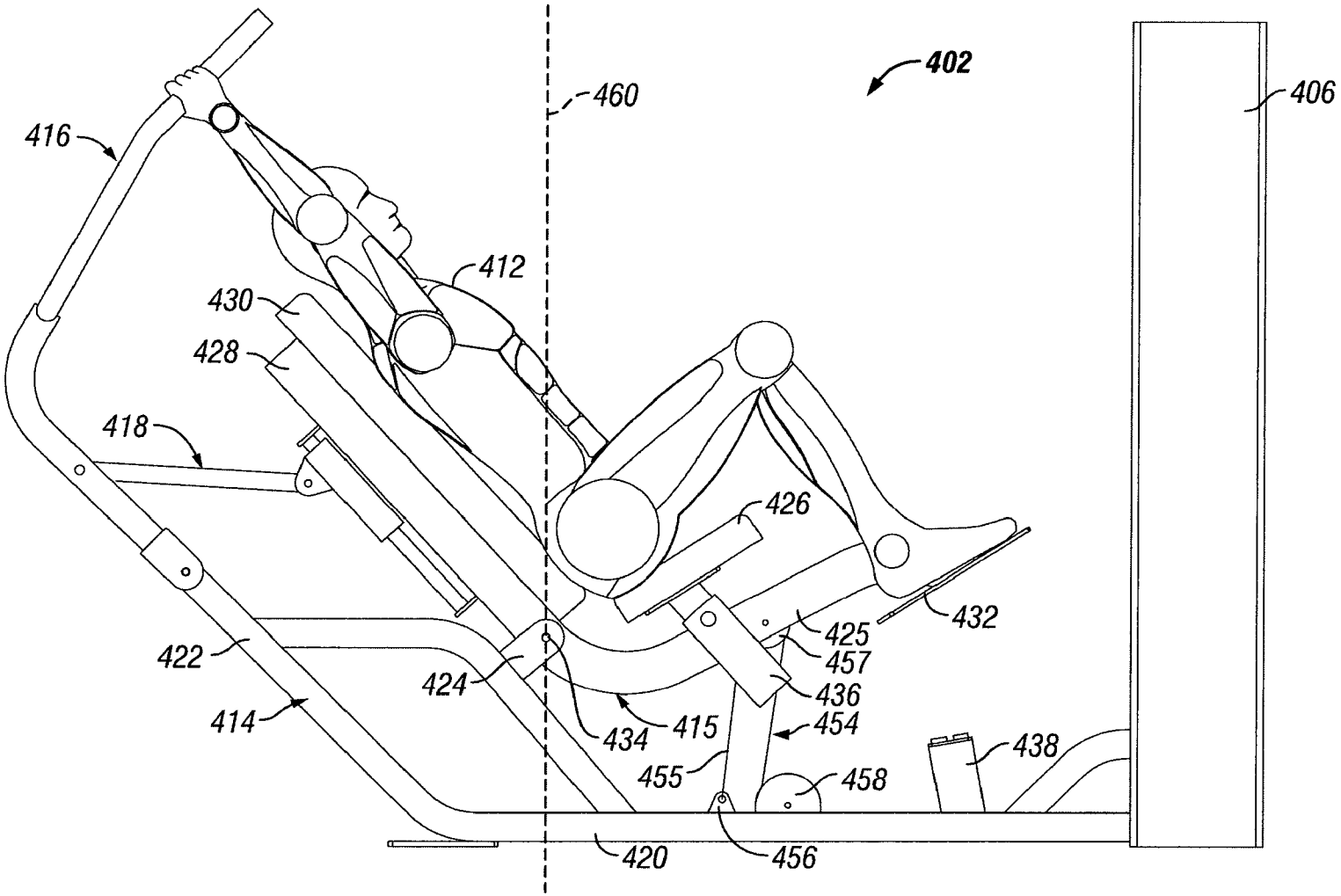
FIG. 11 is a side elevation view of the shoulder press exercise station similar to FIG. 10 but with the user and station in the end position of a shoulder press exercise.

FIG. 9 illustrates the three exercise stations secured together in machine 400, while FIGS. 10 to 15 illustrate the individual stations in more detail. FIGS. 10 and 11 illustrate the shoulder press station 402 in an exercise start and end position, respectively, with a user 412 seated at the station and performing a shoulder press exercise. The shoulder press exercise station 402 is similar to the stand alone shoulder press exercise machine illustrated in FIGS. 9 to 12 of co-pending application Ser. No. 10/633,805, the contents of which are incorporated herein by reference, except that the exercise resistance is linked to the connecting link in that machine, whereas the exercise resistance in station 402 is linked to the pivoted user support, as described below.

The shoulder press station 402 is designed to be similar to a free weight overhead press exercise, while reducing or eliminating the disadvantages of a free weight exercise, i.e. balance, coordination, and strength to follow the proper movement path, and possible injury if the proper movement is not followed. Shoulder press station 402 constrains the user to follow the proper exercise path, while fully supporting the user's body throughout the exercise for comfort and safety.

As illustrated in FIGS. 10 and 11, exercise station 402 basically comprises a main frame 414, a user support frame 415 pivotally mounted on the main frame, an exercise arm 416 pivotally mounted on the main frame and linked to the user support frame by a connecting link 418, and an exercise resistance such as selectorized weight stack in housing 406 linked to the user support frame. The main frame 414 comprises a horizontal base section 420, a rearwardly inclined upright section or strut 422, and a pivot mount section 424. The user support frame 415 is generally L-shaped with a base 425 on which a seat pad or primary user support 426 is adjustably mounted, and an upright 428 on which a back pad or secondary user support 430 is mounted. A foot plate or footrest 432 is secured to the forward end of the base 425 and provides an additional user support which supports a spaced portion of the user's body.

The user support frame 415 is pivotally mounted on the pivot mount section 424 of the main frame for rotation about a pivot axis 434 located close to the junction between the base and upright sections of the user support frame, so that the pivot is positioned directly under the exerciser. The seat pad 426 is mounted on a strut or post 435 which is telescopically engaged in tube 436 on user support base 425 to allow the height of the seat pad relative to the frame to be adjusted. A stop 438 on the main frame adjacent the forward end of the user support frame acts to support the user support frame in the starting position of FIG. 10.

The exercise arm 416 comprises a first member or strut 439 having one end pivoted to the top of rear frame strut 422 for rotation about pivot axis 440, and a U-shaped member 442 which has a central section 443 secured to the opposite end of strut 439 and opposite handle arms 444 extending on opposite sides of the user seat, with user engaging hand grips 445 at the ends of arms 444. The connecting link 418 between the exercise arm and user support comprises an arm or link 419 having a first end pivoted to an intermediate point on strut 439 for rotation about first pivot axis 446 and a second end pivotally secured to a slide member 448 for rotation about second pivot axis 450. The slide member 448 is slideably mounted on a rail or guide bar 452 mounted on the rear of the user support upright 428. The sliding linkage mechanism between the exercise arm and user support frame is similar to that described in U.S. Pat. No. 7,052,444 of Webber, the contents of which are incorporated herein by reference.

The base 425 of the user support frame is linked to the exercise resistance or weight stack via a cable and pulley linkage 454. A cable 455 extends from an anchor 456 on the base 420 of the main frame, over a pulley 457 mounted on the base 425 of the user support, back over a pulley 458 on the base 420 of the main frame in front of anchor 456, and then through the frame and into the weight stack housing 406, where it is linked to a selectorized weight stack in a conventional manner.

FIGS. 10 and 11 illustrate a user 412 performing a shoulder press exercise on the shoulder press station 402. To perform the exercise, the user sits on the seat in the start position of FIG. 10, where the seat is in a slightly rearward reclined position. The user places their feet on the foot rest 432, and grabs the handles 445. In FIGS. 10 and 11, the dotted line 460 represents the gravitational centerline which extends through the user support pivot axis 434, which is the gravitational centerline of the user performing the exercise. As can be seen in FIG. 10, the start position places the user in a slightly reclined position, at an angle of around 22 degrees, with their hands at approximately shoulder level and forward of the side centerline of their body. This is equivalent to the start position of the user's body for a free weight shoulder press.

From the position of FIG. 10, the user pushes the handles upwards, rotating the exercise arm rearwardly about pivot axis 440. At the same time, the exercise arm pulls the connecting link 418 upward and rearward, which in turn forces the linear slide member 448 upwards and causes the user support to rotate rearwards about pivot axis 434. Additionally, upward movement of the base of the user support lifts the selected weights in the weight stack via the cable and pulley linkage 454. The user is placed in a back supported position with their hands slightly forward of the shoulders in the start position, and then follows the slight natural arcing movement of a barbell press, finishing the exercise in a substantially reclined position of around 46 degrees to the gravitational centerline, with their arms fully extended and in line with the side centerline of their body, as illustrated in FIG. 11. This substantially mimics the finish position of a free weight shoulder press exercise. The exercise movement is therefore similar to the slight, natural arcing movement the arms go through when performing a barbell or dumbbell free weight shoulder press exercise.

In this station, the position of the user support pivot axis 434 beneath the user's body distributes the weight of the user's body and the support frame on both sides of the gravitational centerline 460 in both the start and end position of the exercise. The starting position in this case places the user support pivot axis 434 rearward of the exerciser's hips, with the gravitational centerline 460 at or close to alignment with the centerline of their shoulders. The majority of the user's body starts forward of the gravitational centerline and the user rotates rearwards through this centerline during the exercise, and finishes with the centerline extending through their torso for a more evenly balanced distribution of weight at the end of the exercise, as illustrated in FIG. 11. The combined weight of the user and user support has a reduced effect on the amount of starting resistance, since part of the user's weight is still placed rearward of the user support pivot, acting as a counterbalance to the exercise arm. By the same token, as the user passes rearward through the gravitational centerline, there is no appreciable drop off in resistance felt because of the amount of weight which still remains forward of centerline 460.

The user 412 seated on the user support 415 in station 402 is fully supported throughout the exercise movement so that they do not have to worry about balance and coordination, unlike a free weight exercise. The exercise arm and user support are linked to one another to self-align throughout the exercise movement, so that the handles can be angled for a more comfortable start and finish position.

Figure 12:
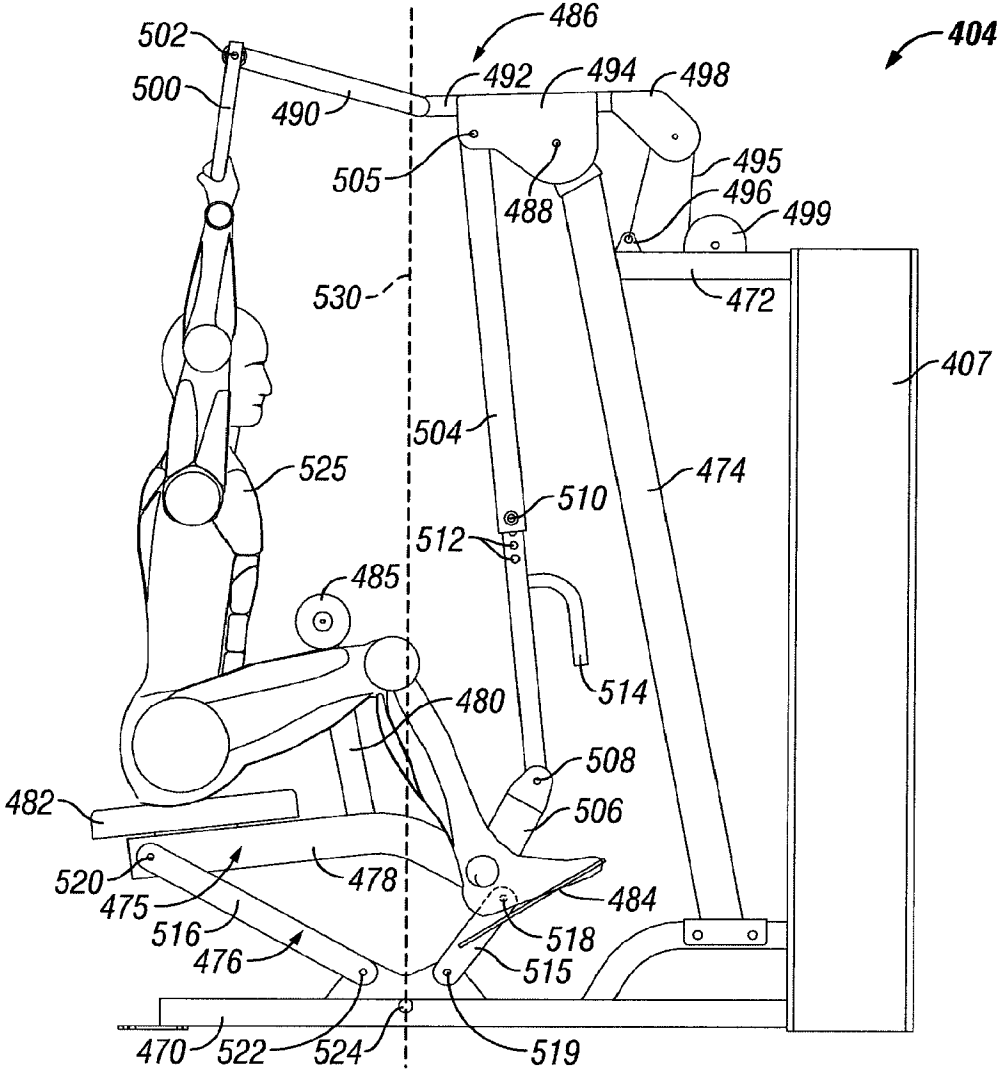
FIG. 12 is a side elevation view of the chin up or pull down exercise station of the machine of FIG. 9 with a user seated on the user support in the start position of a chin up exercise.
Figure 13:
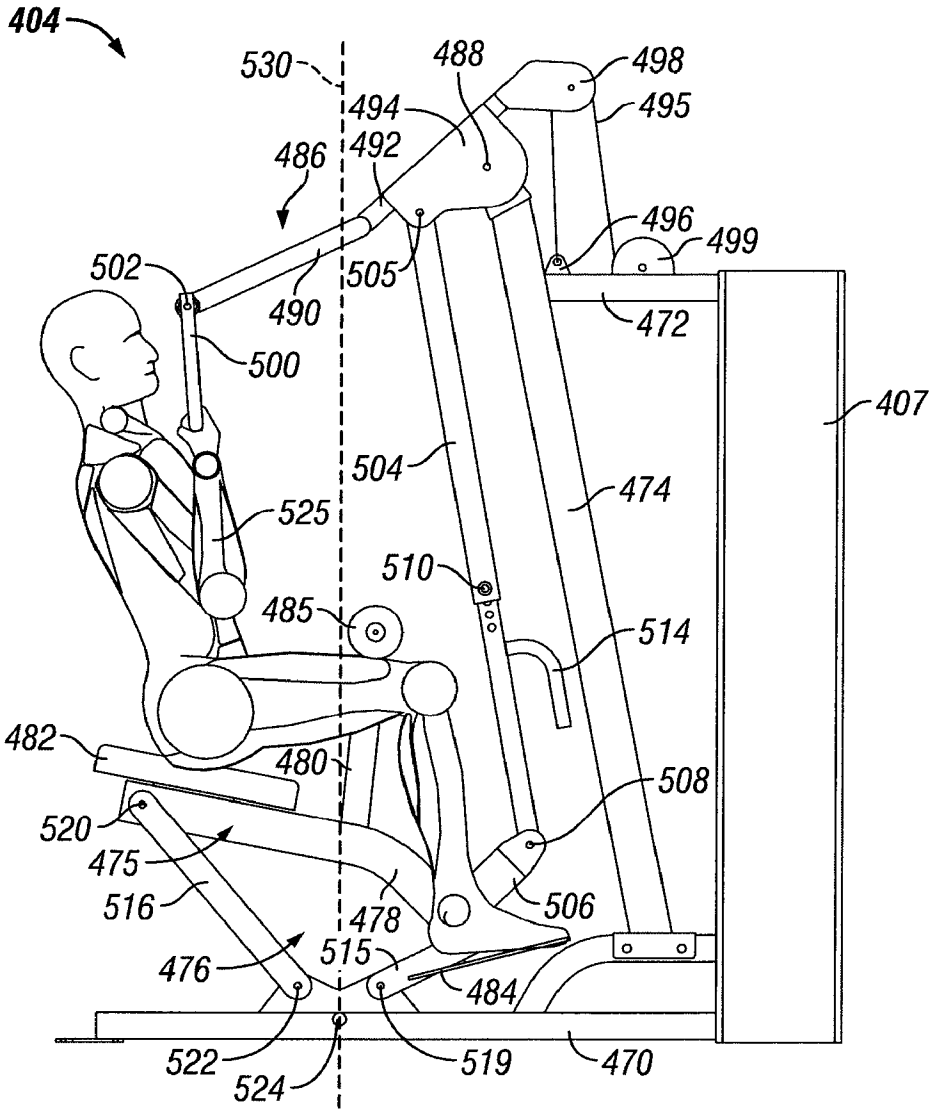
FIG. 13 is a side elevation view of the chin up exercise station similar to FIG. 12 but with the user and station in the end position of a chin up exercise.

The chin up or pull down station 404 is illustrated in FIGS. 12 and 13, and is designed to allow a user to perform chin up type exercises similar to the free body weight exercise performed by a user pulling themselves up from the ground while gripping an overhead bar or "chinning" bar, with the user raising their body until their chin touches the bar. The exercise carried out at station 404 produces user start and end positions similar to the natural body alignment in the start and finish positions of a free body weight chin up exercise. The chin up station 404 is similar to the stand alone chin up or pull down machine illustrated in FIGS. 1 to 4 of co-pending application Ser. No. 10/633,805, the contents of which are incorporated herein by reference.

Station 404 has a main frame having a horizontal base section 470 which is secured to the lower end of weight stack housing 407 at its forward end, an upper strut 472 projecting horizontally from an upper part of housing 407, and a rearwardly inclined upright strut 474 extending upwardly from the base section 470 to a rear end of the upper strut 472.

A generally T-shaped user support frame 475 is pivotally mounted on the base section via a four-bar pivot linkage 476 between the base section 470 and the user support frame. The user support frame 475 has a base portion 478 and an upright member 480 projecting upwardly from an intermediate position on base portion 478. A seat pad or primary support 482 is mounted at the rear end of base portion 478, behind upright member 480. At least one secondary or additional support is also mounted on the user support frame. In this embodiment, one secondary or additional support comprises a pair of roller pads 485 on a strut which is telescopically mounted in member 480. The position of the roller pads 485 can be adjusted by moving the strut up or down and then securing it in position via a spring loaded pull pin (not visible in the drawings). Another secondary support comprises a foot rest 484 mounted at the forward end of base portion 478.

An exercise arm assembly or user engagement device 486 is pivotally mounted at the top of the upright strut 474 to rotate about pivot axis 488. The exercise arm assembly comprises a generally U-shaped exercise arm 490 having a central portion 491 secured to a strut 492 which projects generally forward from arm 490. A pivot mounting bracket or pair of pivot plates 494 is secured to strut 492 and pivoted to the upper end of upright strut 474 for rotation about pivot axis 488. The forward end of strut 492 is linked to the weight stack in housing 407 via a cable 495 extending from anchor 496 on the horizontal strut 472, over a pulley 497 secured between mounting plates 498 at the end of strut 492, then back around pulley 499 on strut 472 and via additional pulleys (not visible in the drawings) to the top of the weight stack. A U-shaped handle bar 500 is pivoted to the ends of the U-shaped exercise arm for rotation about pivot axis 502, and is suspended downwardly from the exercise arm so that the central portion 501 of the handle bar (see FIG. 9) can be gripped by a user with both hands.

An adjustable length connecting link 504 pivotally connects the exercise arm assembly 486 to the forward end of the base 478 of the user support frame. The link 504 has a first end pivoted to the pivot mounting bracket or plates 494 of the exercise arm for rotation about pivot axis 505 which is spaced rearward from pivot axis 488, and a second end pivoted to a pivot mount 506 on the forward end of user support base 478 for rotation about pivot axis 508. The link 504 comprises two telescopically engaging parts which are secured together at a selected extension via a spring loaded pull pin 510 engaging in a selected opening 512 in one of the telescoping parts. A handle 514 is provided to assist in adjusting the length of connecting link 504.

As noted above, the user support frame 475 is pivotally mounted on base 470 via a four bar linkage assembly 476 comprising a pair of pivoted lever or link arms 515, 516 extending between the base 470 of the main frame and the base portion 478 of the user support frame. The first lever arm 515 is pivoted at one end to the forward end of a pivot mount on the base 470 to rotate about a first pivot axis 519, and to the forward end of base portion 478 at the opposite end, to rotate about a second pivot axis 518. The second lever arm 516 is pivoted at one end to the rear end of the pivot mount on base 470 to rotate about a third pivot axis 522, and at the opposite end to the rear end of the base portion 478 to rotate about fourth pivot axis 520. The four bar pivot linkage defines a theoretical pivot 524 about which the user support frame rotates.

FIGS. 12 and 13 illustrate the start and finish positions of a chin up exercise with a user 525 in place on the user support frame 475. To perform the exercise, the user positions themself in a seated position on seat pad 482, which starts in a slightly downwardly reclined orientation as illustrated in FIG. 12. They then slide their legs under the thigh hold down roller pads 485, adjusting the position of these pads by sliding the adjustment strut up and down if necessary, and place their feet on the user support footrest or plate 484. They then grab the handle bar 500 of the exercise arm assembly 486 and pull it downwards. The starting position of FIG. 12 places the user's upper body in a slightly forward lean with their arms extending straight overhead, in line with the side center line of their body. If necessary, the user can adjust the distance between the user support seat 482 and exercise arm bar or handle 500 by adjusting the length of connecting link 504.

As the exercise arm assembly moves downwards, rotating about the pivot axis 488 at the top of strut 474, the connecting link 504 is also pushed down, and pushes the front end of the user support frame 475 downwards, rotating the frame about the four bar linkage into the finish position illustrated in FIG. 13, in which the seat pad 482 is moved from a rearwardly reclined to a forwardly inclined orientation. At the same time, the selected weights in the weight stack are lifted via the cable and pulley linkage between the end of exercise arm strut 492 and the weight stack. As the seat pad changes its orientation from a reclined angle to an inclined angle, the user automatically adjusts their upper body position rearward (relative to their angular position on the seat) to compensate for this change in seat angle, and finishes the exercise with their hands below their chin and slightly in front of their shoulders. This slight rearward movement is similar to the natural rearward arc a person's upper body goes through when performing a free bar chin up. The chin up station 404 provides the user with a safer and more comfortable exercise movement than was possible with previous rigid arm pull down exercise machines.

The user support pivot is positioned under the user support frame such that a substantial portion of the combined weight of the user and the user support frame is positioned on each side of the gravitational center line 530 which extends through the theoretical pivot 524 of the four bar pivot linkage 476 in both the start and finish position. Since the pivoting motion is provided by a four bar linkage, the center line 530 is a theoretical center line of the pivotal movement. The portion of both the user and the user support positioned on each side of line 530 varies only very slightly from the start to the end point of the exercise movement, as can be seen in FIGS. 12 and 13. This balanced distribution minimizes the effect that the combined weight of the user and user support has on the exercise resistance, while still allowing it to act as a counter balance to offset the weight of the exercise arm. The combined weight of the user and user support frame has little effect on the amount of starting resistance, because a substantially equal amount of weight is balanced rearward of the user support pivot. By the same token, because only a small portion of the user passes through the gravitational center line 530 during the exercise, there is no appreciable drop off in resistance felt by the user.

In this embodiment, the user 525 is in a forward lean of approximately 3.5 degrees off vertical in the start position, with their arms fully extended and in line with the body side centerline. At the end of the exercise, as illustrated in FIG. 13, the user is reclining at approximately 19 degrees, with their hands positioned under the chin and slightly forward of their shoulders. Thus, the upper body moves through an angle of approximately 22.5 degrees, which is similar to the movement when performing a free chin up exercise with an overhead chinning bar.

The primary user support in exercise station 404 is the seat pad 482, while a secondary support is provided by the thigh hold-down pads 485. A further support or stabilization means is provided by the foot plate 484 which travels with the user support frame 475. The multiple user supports help to provide proper positioning of the user relative to the user engaging portion of the exercise arm throughout the entire exercise movement. This also makes the apparatus much more comfortable and natural for the user, making the user want to exercise. The foot plate keeps the user's feet in the same relaxed and supported position throughout the entire exercise movement.

Figure 14:
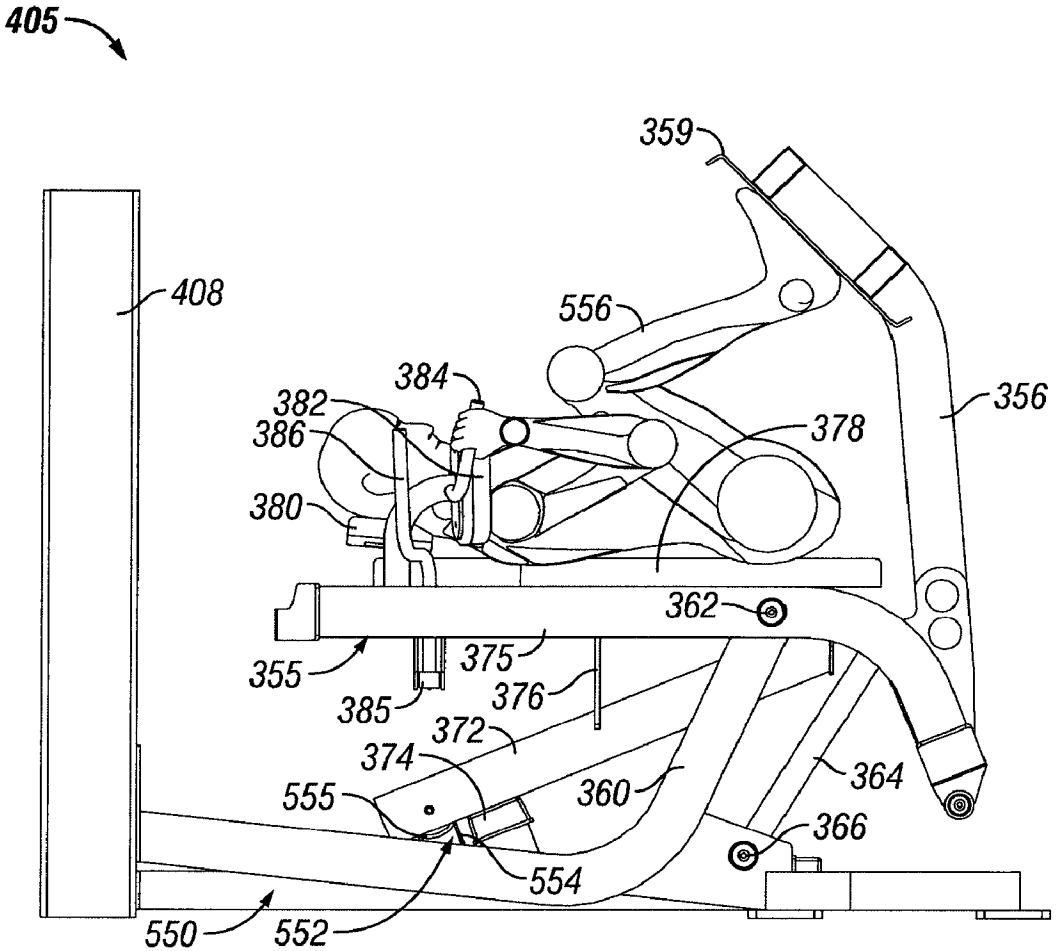
FIG. 14 is a side elevation view of the leg press exercise station of the machine of FIG. 9 with a user seated on the user support in the start position of a leg press exercise.
Figure 15:
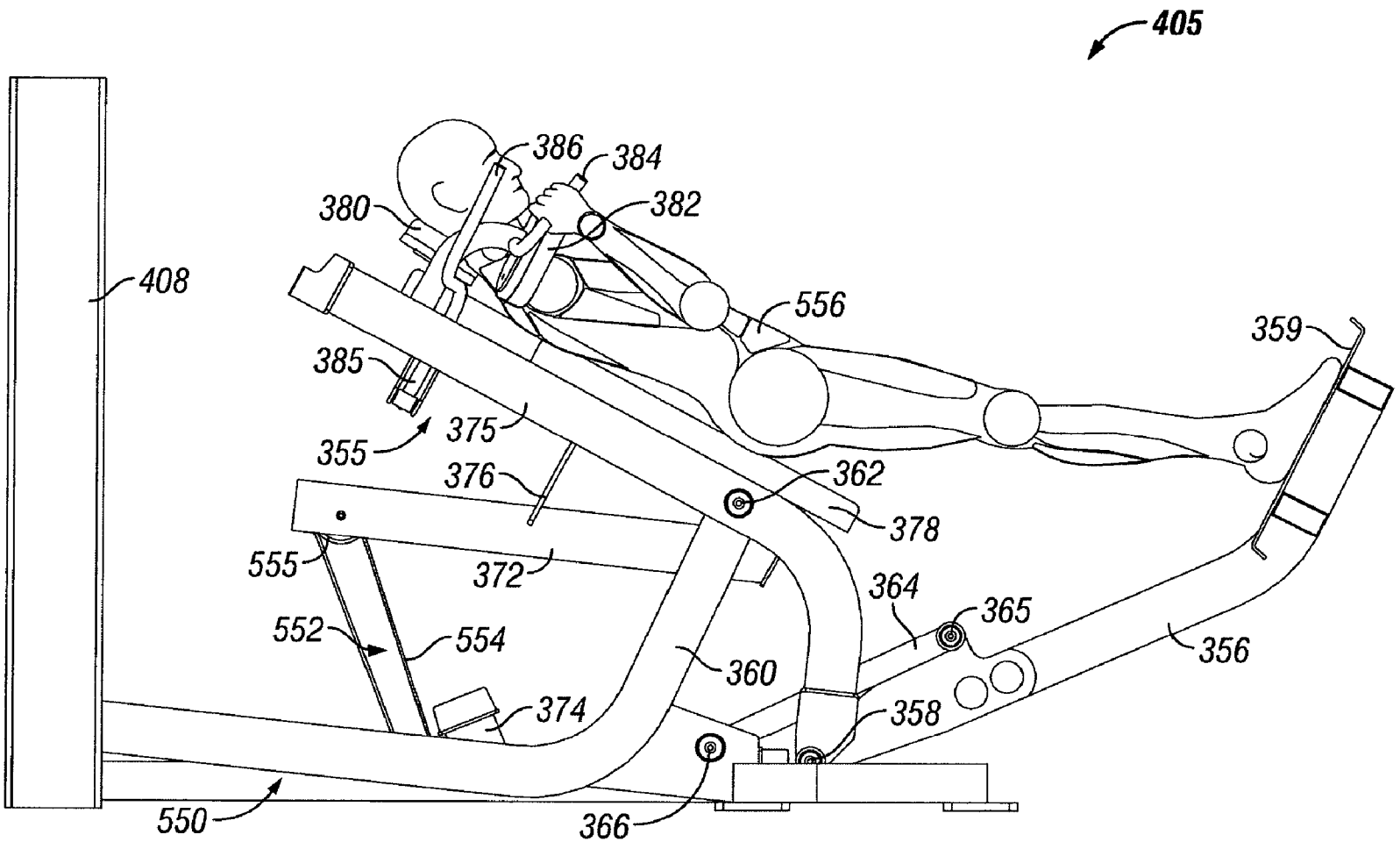
FIG. 15 is a side elevation view of the leg press exercise station similar to FIG. 14 but with the user and station in the end position of a leg press exercise.

FIGS. 14 and 15 illustrate the start and end positions of a leg press exercise performed on exercise station 405 of FIG. 9. The exercise station 405 is substantially identical to the leg press station 304 of the machine 300 of FIGS. 7 and 8, and like reference numbers are used for like parts as appropriate. The main difference in station 405 is that the exercise resistance is provided by weight stack in the weight stack housing 408, rather than hand loaded weight plates as in the station 304.

The leg press station has a main frame with a base portion 550 which is connected to the base of the weight stack housing 408. As noted above, most of the components of leg press station 405 are identical to those described above in connection with leg press station 304 of FIGS. 7 and 8, except that the weight plates 368 at the end of user support lower strut 372 are replaced by a connection to the weight stack in housing 408. The lower strut 372 of the user support frame 355 in station 405 is linked to the weight stack in housing 408 via a cable and pulley assembly 552 which includes a cable 554 which extends from an anchor (not visible in the drawings) on the base portion of the main frame around a pulley 555 at the end of lower strut 372 of the user support frame 355, then back to the base portion 550 where it extends around another pulley (not visible in the drawings) and into weight stack housing 408, where it is linked to a selectorized weight stack in a conventional manner.

Operation of leg press station 405 is identical to that described above in connection with station 304 of the previous embodiment, apart from the exercise resistance provided by a selectorized weight stack rather than hand loaded weight plates. FIGS. 14 and 15 illustrate a user 556 positioned on the user support 355, with FIG. 14 illustrating the start position of a squat or lying leg press exercise, and FIG. 15 illustrating the end position. The exercise movement is exactly the same as described above in connection with leg press station 304 of FIGS. 7 and 8.

In the multi-station exercise machine of FIGS. 9 to 15, each station has its own weight stack, and the stations can be used completely independently of one another. Each station in this embodiment has a pivotally mounted user support and a connecting linkage translates movement of the exercise arm or user engagement device into movement of the user support. However, in alternative embodiments, one or two of the exercise stations may have a fixed user support, as is the case with station 154 of FIGS. 5 and 6. Additionally, a greater number of exercise stations my be arranged around a central gang of weight stacks in alternative embodiments, and one or more of the exercise stations 402, 404, and 405 of the illustrated embodiment may be replaced with stations for performing different exercises, such as pec fly, chest press, mid-row, rear deltoid, seated dip, and the like.

In the foregoing embodiments, the exercise stations with moving user supports are designed for performing compound exercises which involve more than one muscle or muscle group. However, any of the stations in the foregoing embodiments may be replaced by a station designed for performing isolation exercises designed to isolate and exercise a specific muscle or muscle group. FIGS. 16 to 24 illustrate a multiple station exercise machine 600 according to another embodiment which has two isolation exercise stations 602, 604 connected together in a side-by-side manner, rather than aligned face-to-face or back-to-back as in the previous embodiments of FIGS. 1 to 8. The exercise stations 602, 604 may alternatively be arranged back-to-back or facing each other in line as in previous embodiments, depending on space requirements, and the aligned stations of FIGS. 1 to 8 may alternatively be positioned side-by-side in the same manner as in exercise machine 600. One or both stations may also be combined with two or more additional stations in a radial array arrangement as illustrated in FIG. 9, in other alternative embodiments. In other embodiments, either of the exercise stations 602 or 604 of machine 600 may be replaced with any of the exercise stations in the previous embodiments.

Figure 16:
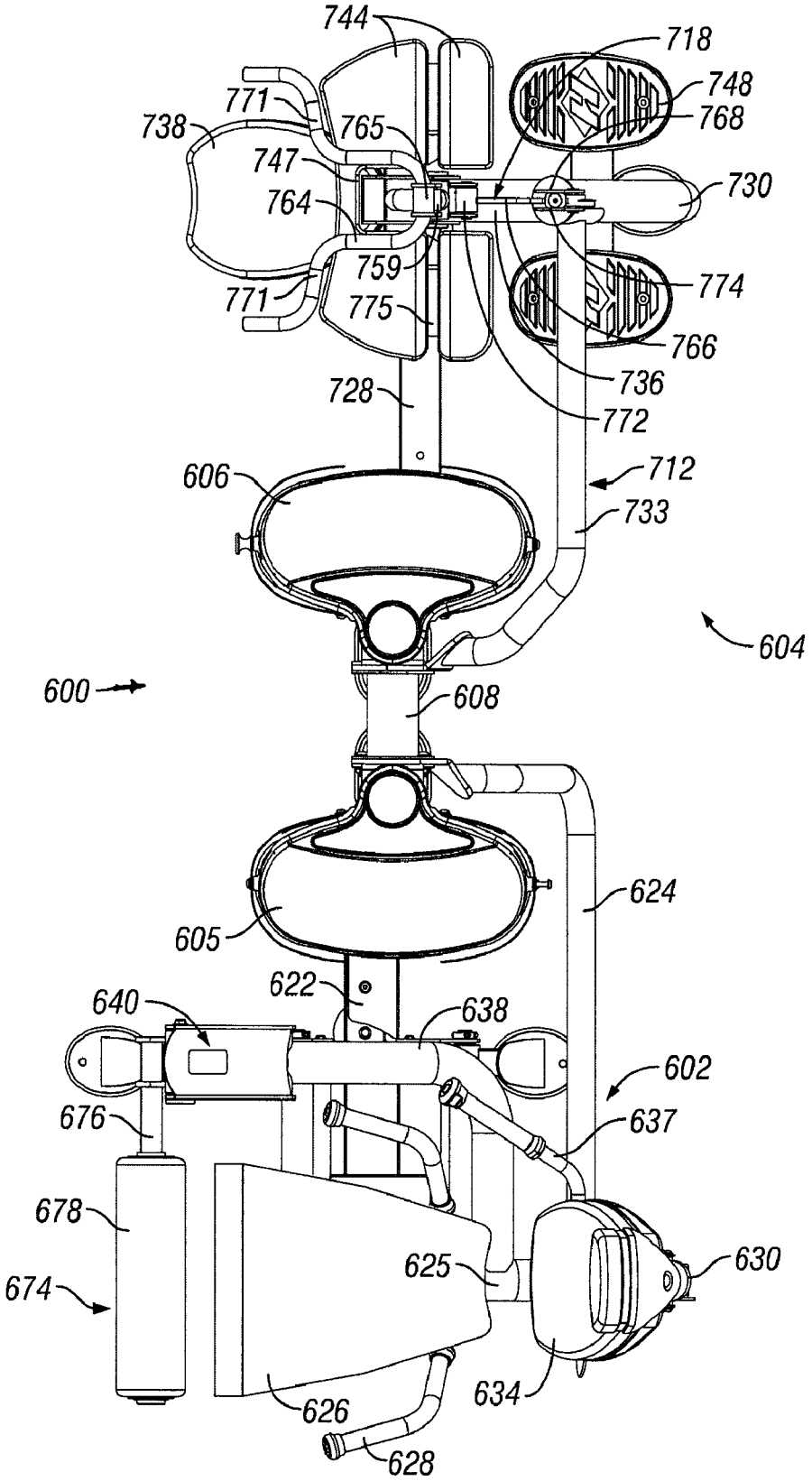
FIG. 16 is a top plan view of another embodiment of a multi-station exercise machine.

The first exercise station 602 of FIG. 16 is a leg extension exercise station which is illustrated in more detail in FIGS. 17 to 20. The second exercise station 604 is an arm exercise station, specifically a biceps curl exercise station, and is illustrated in more detail in FIGS. 21 to 24. Each of these stations is designed for performing an isolation exercise. A leg extension exercise is an isolation exercise because it involves a single joint, the knee; requires movement of just one body part, the lower leg; and targets a specific muscle group, specifically the quadriceps. A biceps curl exercise is also an isolation exercise which involves a single joint, the elbow, movement of a single body part, the lower arm; and targets a specific muscle group, the biceps. In other embodiments, alternative isolation stations may involve leg curl exercises or triceps extension exercises.

As illustrated in FIG. 16, the multi-station machine 600 has two weight stack housings 605, 606 connected together back-to-back via a connecting strut 608, and a weight stack in each housing provides exercise resistance or load for the respective isolation exercise stations. This means that the stations can be used independently from one another. The weight stacks of FIG. 16 may be replaced by other types of exercise resistance such as weight plates or the like in alternative embodiments, for example as illustrated for the multiple station exercise machine of FIGS. 7 and 8. The exercise stations 602 and 604 are positioned generally parallel to one another on opposite sides of the central weight stack housings 605 and 606.

Leg extension station 602 is similar or identical to the leg extension machine illustrated in FIGS. 1 to 5 of co-pending application Ser. No. 11/846,472 filed on Aug. 28, 2007, which is referenced above, the entire contents of which are incorporated herein by reference. In alternative embodiments, station 602 may be replaced by any of the other embodiments described in co-pending application Ser. No. 11/846,472 referenced above. As illustrated in FIGS. 16 to 20, station 602 comprises a main frame 610 secured to weight stack housing 605, a user support 612 pivotally mounted on the frame by a four-bar pivoting linkage system 614, a leg exercise arm assembly 615 pivotally secured to the seat section of the user support, and a connecting link 616 which links movement of the exercise arm to movement of the user support.

Main frame 610 has a first section on which the user support and associated components are positioned and a second section which connects the first section to the weight stack housing 605. The first section has a ground engaging base portion 620 and a rear inclined upright or post 621. The second section of the main frame 610 connects the first section to the weight stack housing 605 which is positioned on one side of the user support 612. As illustrated in FIG. 16, the second section comprises a lower connecting strut 622 which extends transversely from base portion 620 and is connected to the base of the weight stack housing, and an upper connecting strut 624 which is connected to upright 621 at one end, and to the rear of the weight stack housing 605 at the other end.

The user support frame 612 has a base portion 625 with a seat pad 626 and support handles 628 fixedly attached to the base portion. A back rest support strut 630 is pivotally attached to the rear end of the base portion 625 and extends generally upwardly from the base portion, and a back pad 634 is mounted in front of strut 630. A range-of-motion (ROM) adjustment device 635 is connected between the base portion 625 and back rest support strut 630 for varying the back rest angle and locking the back rest in the adjusted position, as explained in more detail in co-pending application Ser. No. 11/846,472 referenced above, and reference is made to that application for a detailed description of the adjustment device 635. The back rest adjustment allows adjustment of the back supported positioning for various size users. Adjustment handle 637 linked to the ROM adjustment mechanism allows the user to adjust the back rest position. An "L" shaped outrigger tube 638 extends from seat base portion 625 to one side of the seat. One end of the outrigger tube 638 is attached to the seat base portion or strut at the rear of seat pad 626, as best illustrated in FIG. 16, while the second, outward projecting end has a pivot bracket assembly 640 attached at its end.

The four-bar pivot linkage system or pivot assembly 614 between the main frame and seat frame comprises a first pivot link 660 and a second pivot link 662 each pivoted at one end to the main frame and at the other end to the user support frame. The first pivot link 660 is pivotally attached at one end to the rear upright 621 for rotation about pivot axis 664 and pivotally attached at its second end to the rear end of the user support base portion or seat support tube 625 for rotation about pivot axis 665. As described in U.S. patent application Ser. No. 11/846,472 referenced above, the first pivot link 660 comprises two plates connected together at a central region by shaft 666.

The structure of the second pivot link 662 of the four-bar linkage system 614 is also described and illustrated in more detail in U.S. patent application Ser. No. 11/846,472, and comprises a multiple part assembly pivotally connected at one end between two base struts of the main frame base 620 to pivot about pivot axis 668, and pivotally connected at the other end to user support base portion 625 to pivot about pivot axis 670.

The exercise arm 615 is also described and illustrated in more detail in U.S. patent application Ser. No. 11/846,472 referenced above, and comprises a main tube 672, a user engaging device 674 extending to one side of the main tube 672, and a stand-off tube (not visible in the drawings). The main tube 672 rotates about first exercise arm pivot axis 675 via a pivot bracket assembly or housing 640 at one end. The user engaging device 674 comprises a pad mounting tube 676 with a leg engaging roller or pad 678 telescopically mounted over tube 676. A pair of connecting brackets are secured approximate the free end of tube 676 and are pivotally connected to the main tube 672 to rotate about second exercise arm pivot axis 680. This pivotal connection enables the leg engaging pad 678 to self-align to the user during the exercise and automatically adjust to the user's leg length.

The connecting link 616 comprises a pair of spaced bars 682 connected together by connecting bars or tubes. A first end of the connecting link is pivotally attached at or adjacent the front end of the base portion 620 for rotation about a first connecting link pivot axis 684. A second end of the connecting link extends into the space between the opposite sides or plates of pivot bracket assembly 640 and is pivotally attached to a link connecting pivot mount or sleeve at the end of exercise arm stand-off for rotation about a second connecting link pivot axis which is hidden between the plates of pivot bracket assembly 640. A shield plate or cover 685 extends over the pivot bracket assembly 640 to form a housing or enclosure which restricts access to the moving parts and protects the user's fingers.

In this exercise station, the user support is pivotally mounted to the main frame via the user support four-bar linkage pivot system, with the first and second pivoting links connecting the first and second pivot mounts on the main frame and user support respectively. The exercise arm is pivotally connected by its first pivot mount to the pivot bracket assembly 640 mounted on the user support outrigger tube 638. The connecting link 616 pivotally joins to the exercise arm 615 with the main frame via the link connecting pivot mounts.

A cable and pulley system links the weight stack in housing 605 to a cam on the rear of the exercise arm main tube 672. The cable 687 of the cable and pulley system (see FIGS. 19 and 20) is linked to an anchor on exercise arm 672. The cable and pulley system includes a pulley 688 on outrigger tube 638 and a pulley 690 on the base 620, respectively. However, different cable and pulley paths may be provided in alternative embodiments.

Figure 17:
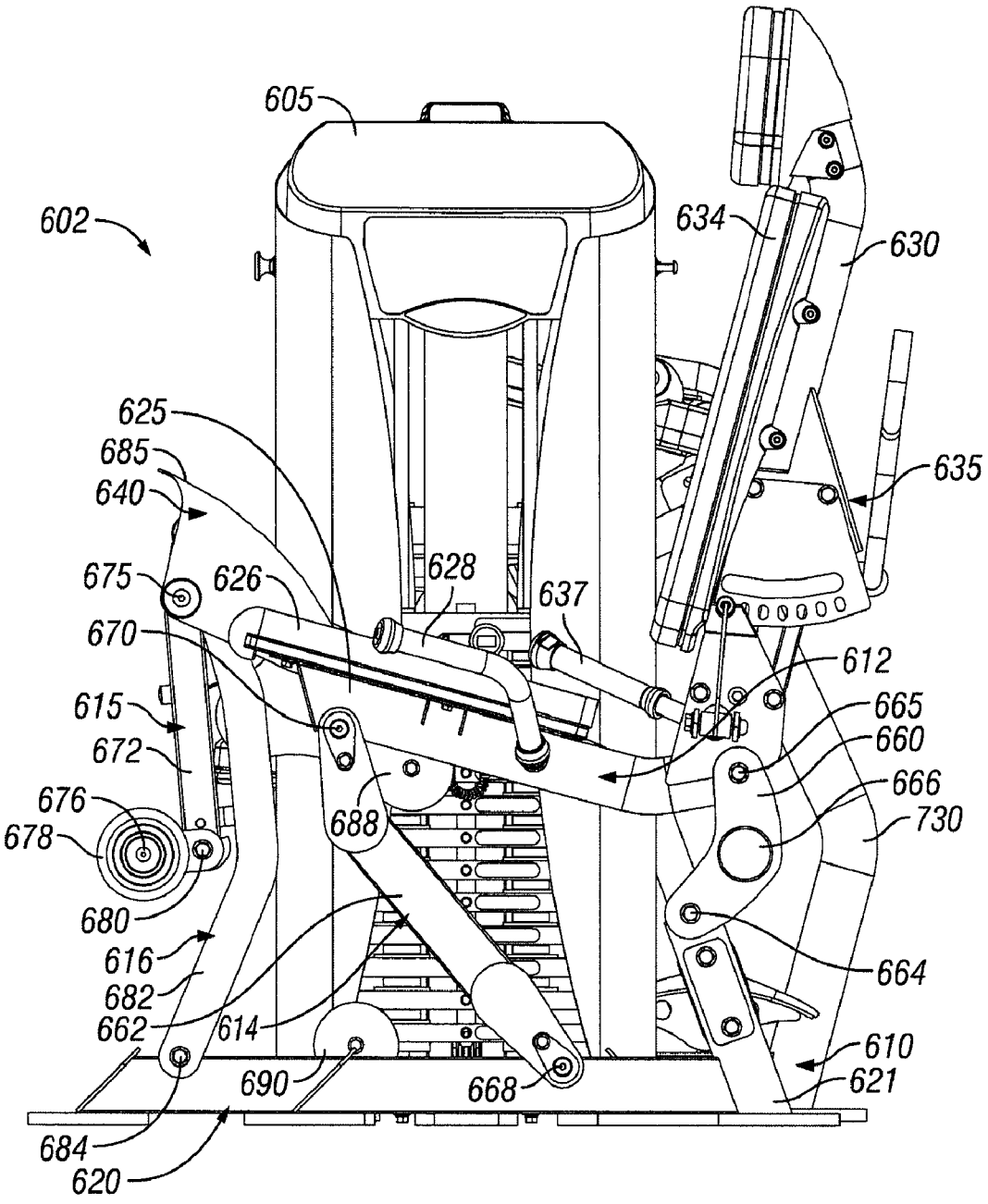
FIG. 17 is a side elevation view of the leg extension station of the machine of FIG. 16 in a start position for a leg extension exercise.
Figure 19:
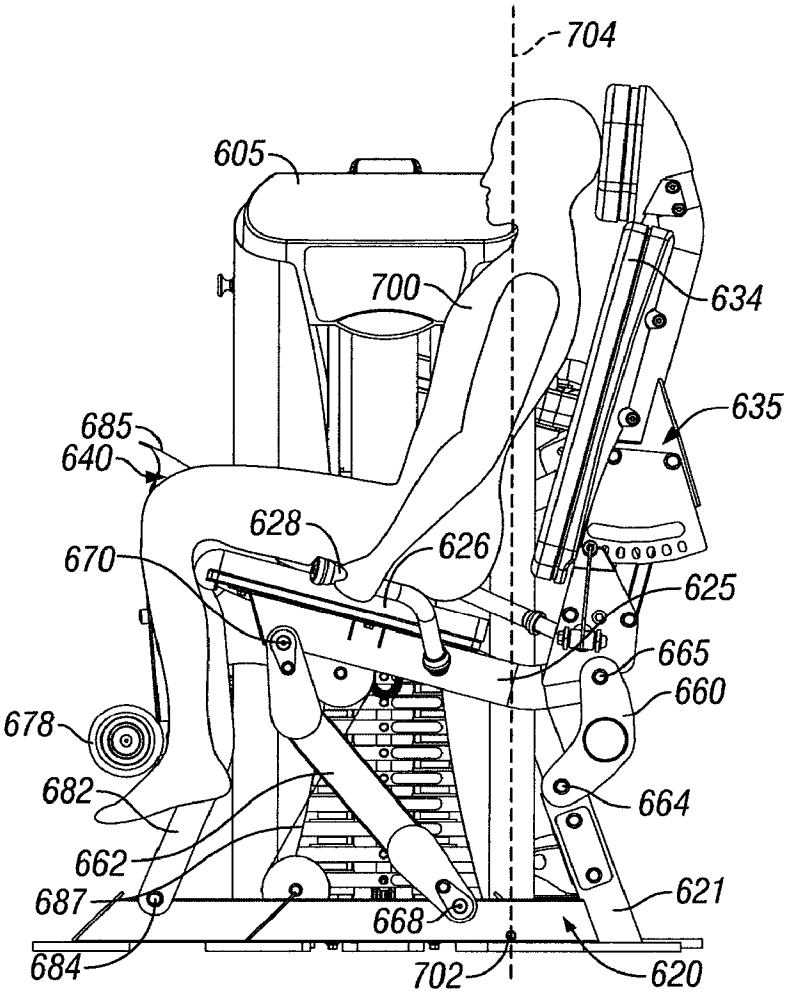
FIG. 19 is a side elevation view similar to FIG. 17 but illustrating a user in position on the leg extension station in the start position.

FIGS. 17 and 19 illustrate the start position for a leg extension exercise, with FIG. 19 illustrating a user 700 seated on the user support ready to perform the exercise. In the start position, the user sits on the seat with their back against the back pad, their knees bent and their feet behind the leg engaging roller 678, as illustrated in FIG. 19. They may grab the support handles 628 for additional bracing if desired. The user then starts the exercise movement by extending their lower legs outward. This movement causes the exercise arm 672 to pivot about pivot axis 675 at its connection to the user support pivot bracket assembly 640, which simultaneously rotates the stand-off rearward. As the stand-off rotates rearward, it causes the connecting link 616 to rotate rearward as well, as it pivots about its pivotal connection to both the exercise arm and the main frame. This in turn forces the user support to rotate, tilting it rearward about the user support four-bar pivoting linkage system 614, so that the rear end of the set pad rotates down and the front end rotates up. This means that the hips of a user seated on seat pad 626 drop down while their knees move up when moving from the start position of FIG. 19 to the end position of FIG. 20.

Figure 18:
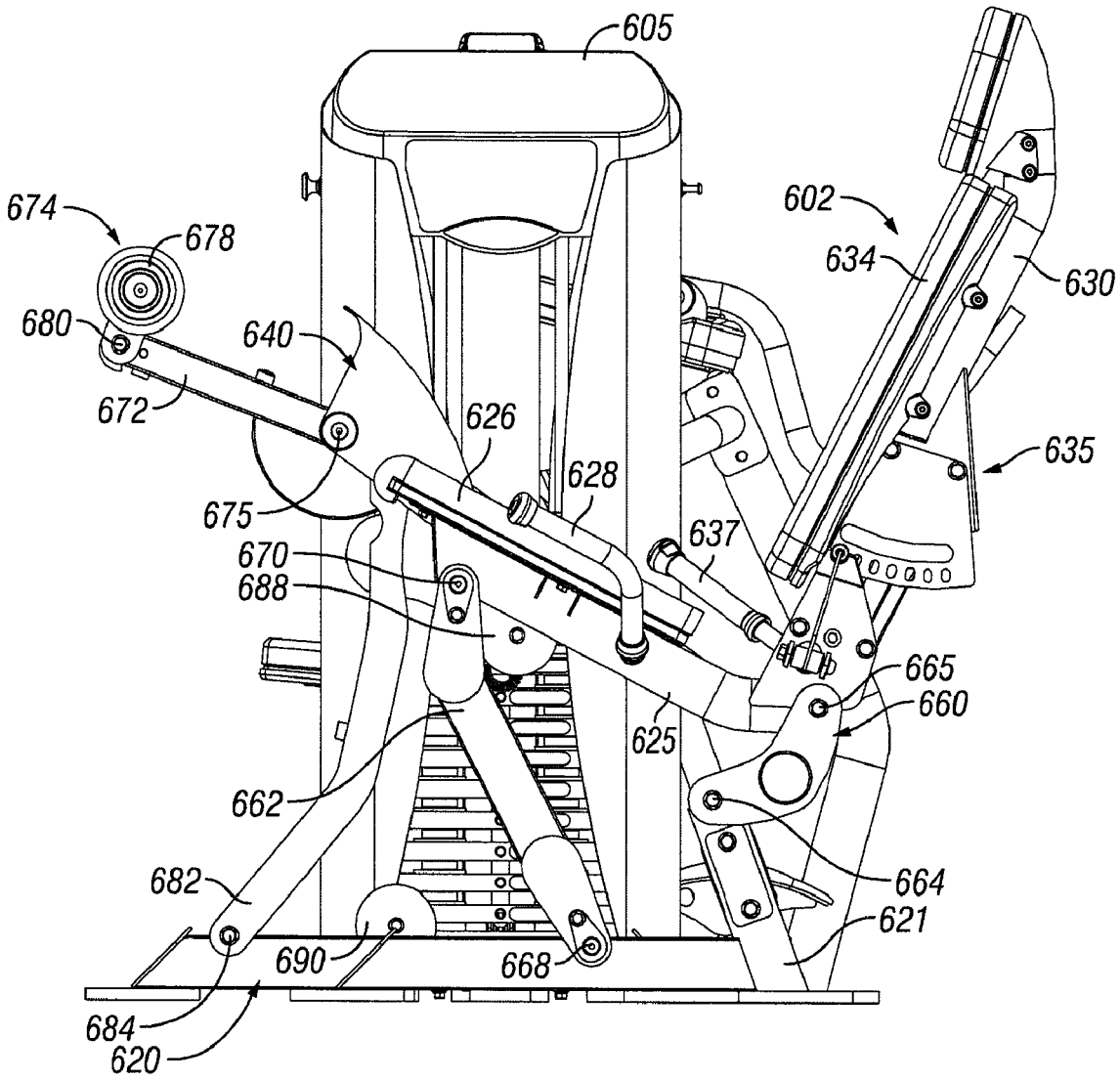
FIG. 18 is a side elevation view similar to FIG. 17 but with the leg extension station in a finish position for a leg extension exercise.
Figure 20:
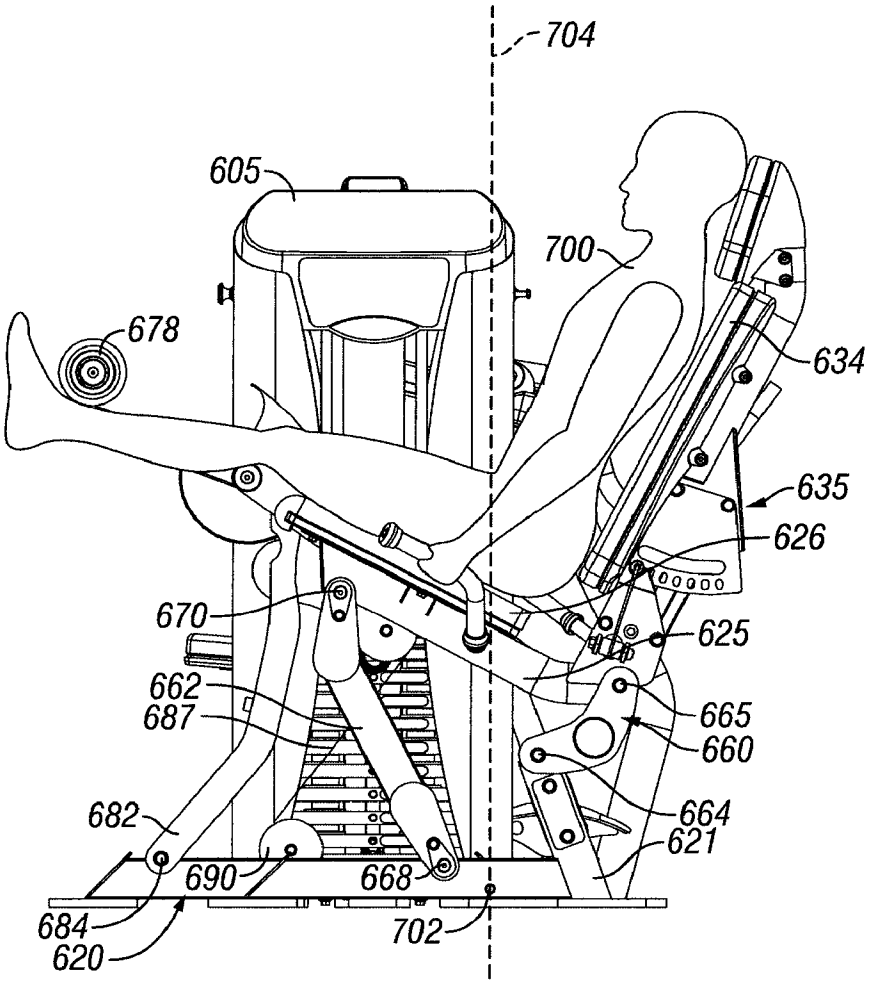
FIG. 20 is a side elevation view similar to FIG. 19 but illustrating the end of a leg extension exercise.

The four-bar pivoting linkage system is designed to control the upward and rearward movement of the user support seat and to reorient the seat from a relatively flat start position to an angled end position as illustrated in FIGS. 18 and 20. By using the four-bar linkage as the user support pivot system, all the pivoting action can take place under the user with the pivot mounts conveniently located on the main frame and user support. However, the theoretical pivot or combined pivot point of the four-bar linkage system is actually located elsewhere. The theoretical pivot is the point where a single pivot would have to be located in order to mimic the same user support movement pattern achieved by the four-bar pivoting linkage.

FIGS. 19 and 20 illustrate the location of the theoretical pivot 702 of the four-bar pivoting linkage system 614. An explanation of how the theoretical pivot axis of the multiple pivot linkage can be calculated is provided in U.S. patent application Ser. No. 11/846,472 referenced above, and is therefore not explained in detail here. Briefly, the centerline of the arcing movement of each of the pivot links 660, 662 between the start and end position is plotted and the point in space where the two centerlines intersect is the theoretical pivot point 702. Vertically bisecting this point produces the gravitational centerline 704 of the user support movement. As can be seen in FIGS. 19 and 20, the gravitational centerline extends through the user support (and user) in each of the start and finish positions of the exercise. The majority of the user's body starts forward of the gravitational centerline and the user rotates rearwards through this centerline during the exercise, and finishes with the centerline extending through their torso for a more evenly balanced distribution of weight at the end of the exercise, as illustrated in FIG. 20. This produces similar advantages to those described above in connection with the rocking seat exercise stations of the previous embodiments.

The advantage of the four-bar pivot system with the theoretical pivot is that it duplicates the movement pattern of a single point pivot that might normally be located in an area impossible to access due to either structural or user interference, so that a desired movement pattern may be achieved while keeping the moving parts of the pivot mount beneath the user support. The combined exercise arm and user support movement illustrated in FIGS. 17 to 20 may not be possible with a single pivot.

The leg extension exercise station 602 has a relatively flat seat in the starting position of FIGS. 17 and 19, and the starting seat height is relatively low to the ground to make entering, position adjustment and exiting easier. As soon as the exercise arm is engaged, the seat starts to recline to maintain the beginning pre-stretch and continues to recline as the leg exercise arm 672 is extended upward and the user straightens their legs. The finishing position is not severely angled so that the user can achieve a full extension to their legs. Because the seat angle starts out relatively flat and gradually reclines, there is little or no undue stress placed on the knee during the exercise.

The pivoting action of the seat drops the user's hips while it raises their knees, and the user tends to stay firmly planted in the user support. There is no need for any extra hold down support because there is little or no teeter-totter effect with the hips trying to lift up off the seat. Instead, the pivoting seat is continuously moving the user hips in the opposite or downward direction from the legs. In this isolation exercise machine, the pivoting joint of the user (in this case the user's knee) is substantially aligned with pivot axis 675 of the leg exercise arm throughout the exercise, as seen in FIGS. 19 and 20.

The combined exercise arm and user support movement of the isolation leg extension exercise machine is made possible by the four-bar pivoting linkage system 614, which duplicates the movement pattern of a single point pivot that would otherwise be located beneath the machine, as illustrated in FIGS. 19 and 20.

Figure 21:
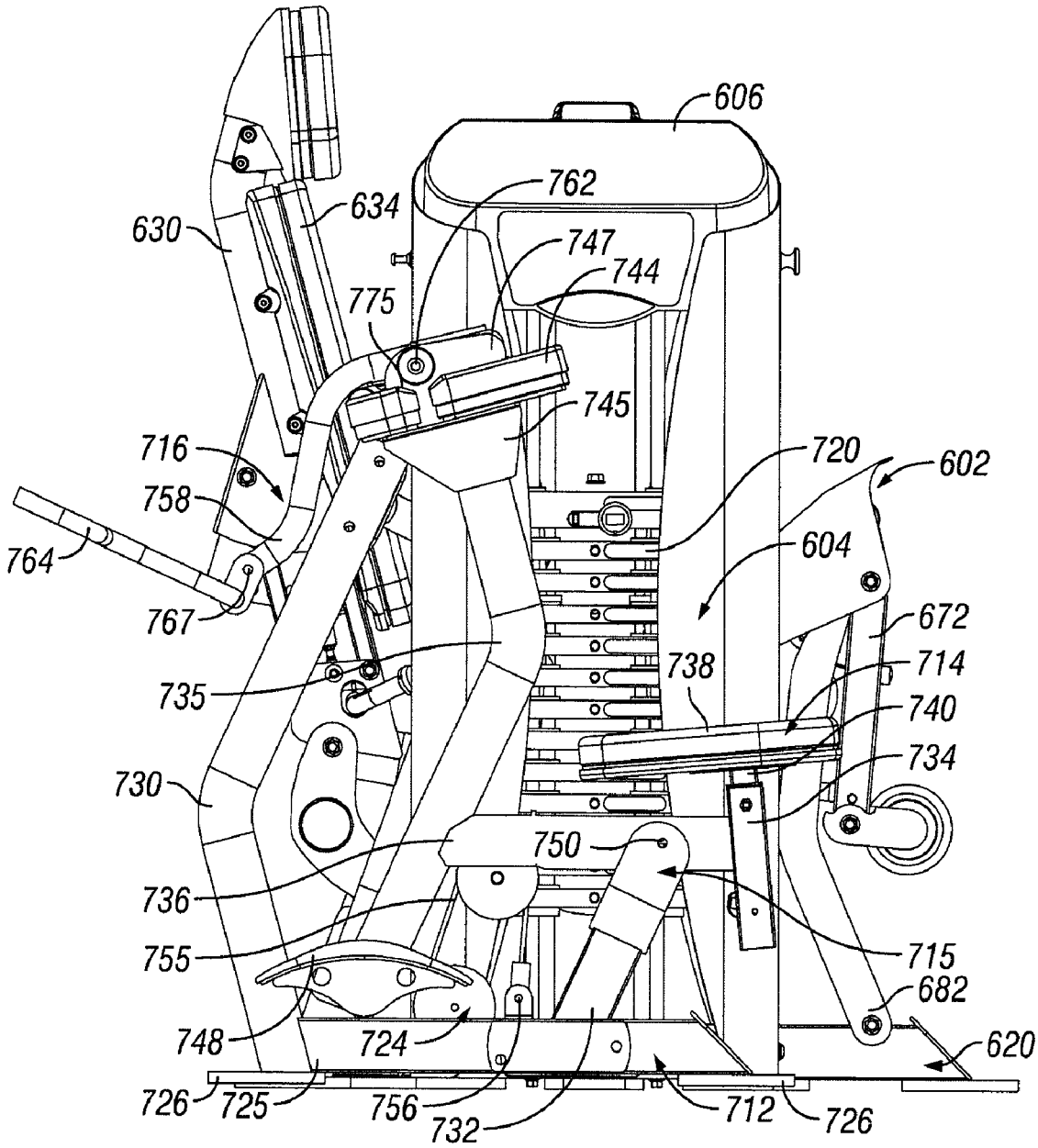
FIG. 21 is a side elevation view of the arm exercise station of the machine of FIG. 16 in a start position for an arm exercise.
Figure 22:
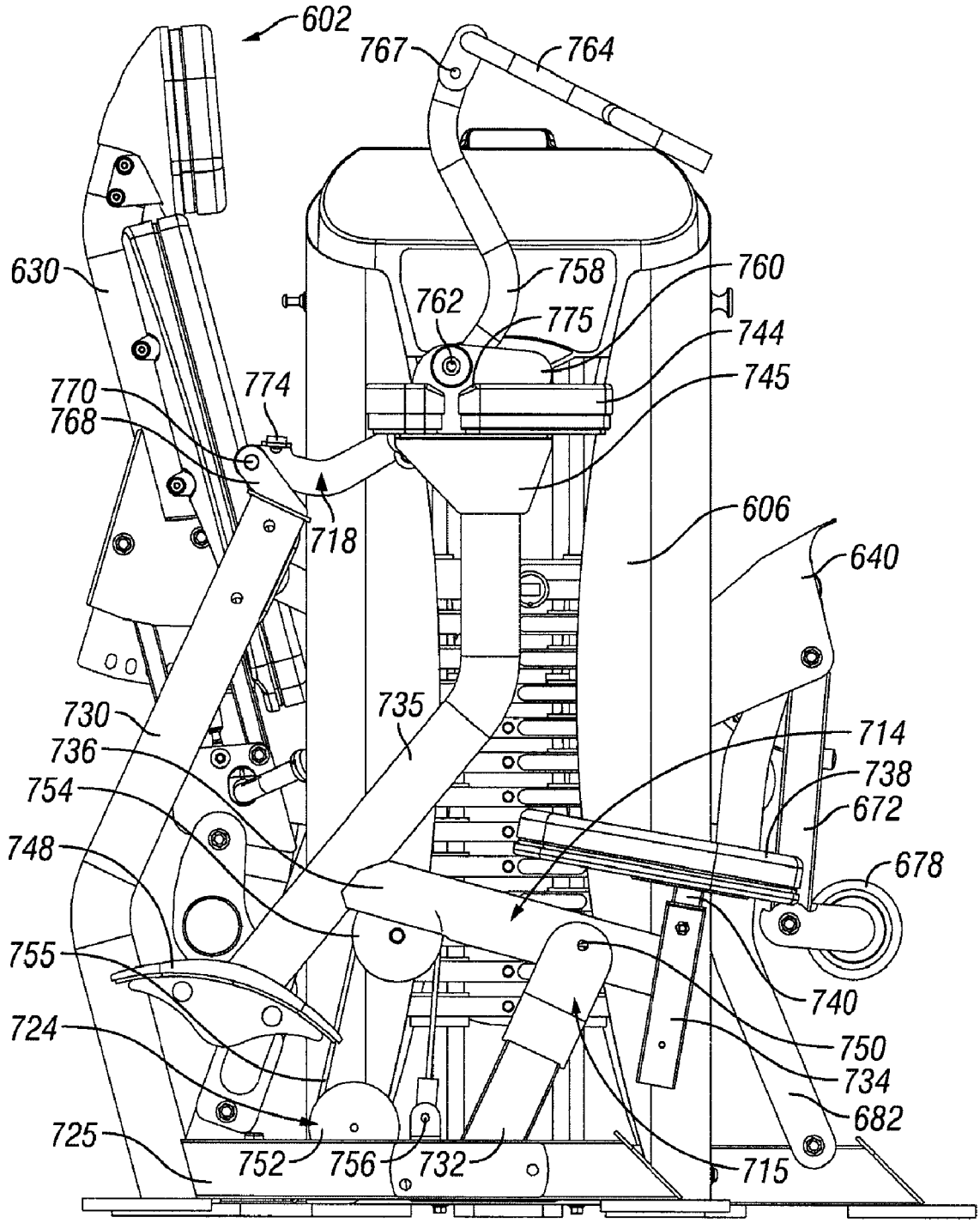
FIG. 22 is a side elevation view of the arm exercise station similar to FIG. 21 but illustrating an end position for an arm exercise.
Figure 23:
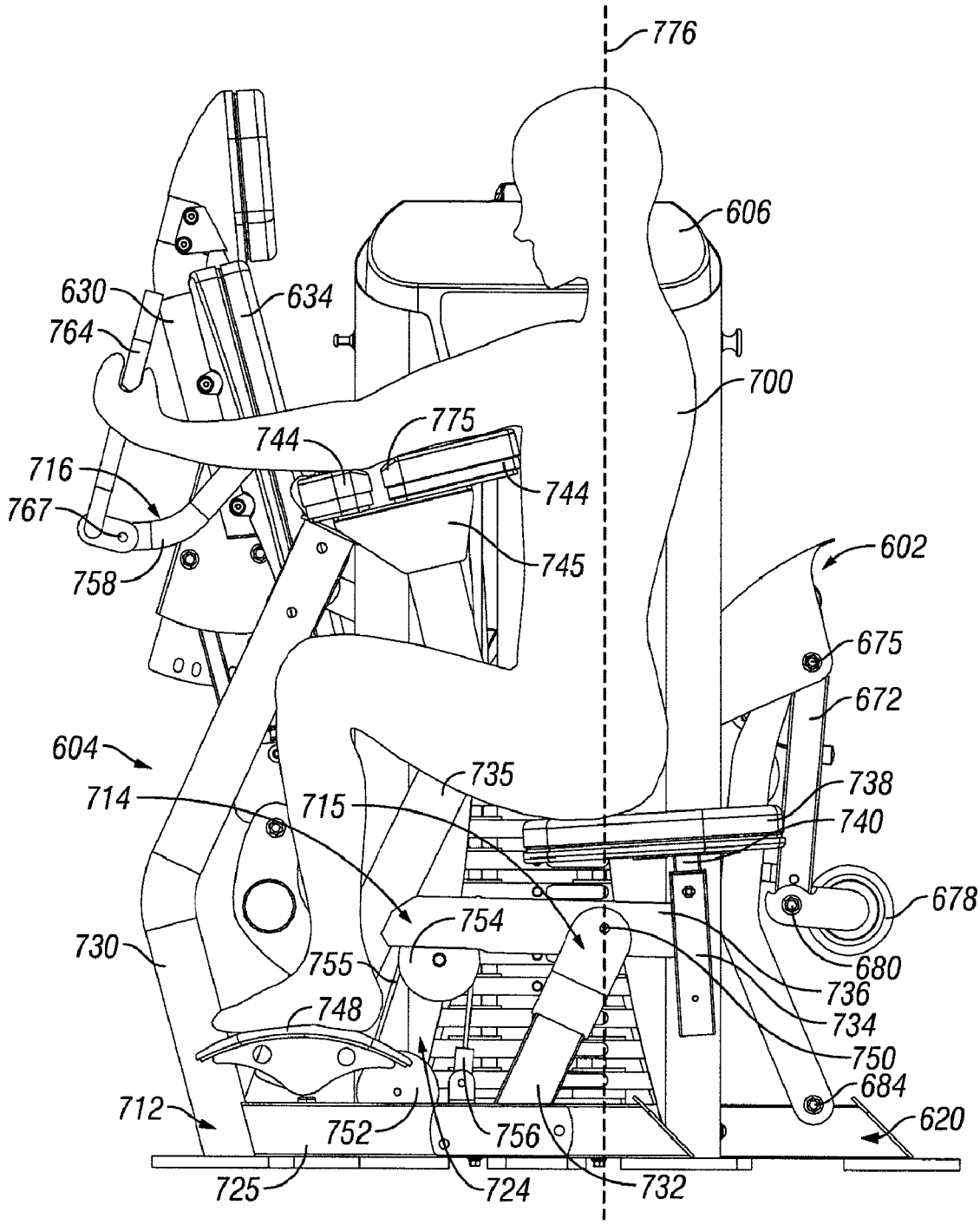
FIG. 23 is a side elevation view of the arm exercise station similar to FIG. 21 but with a user positioned on the arm exercise station in the start position for an arm exercise.
Figure 24:
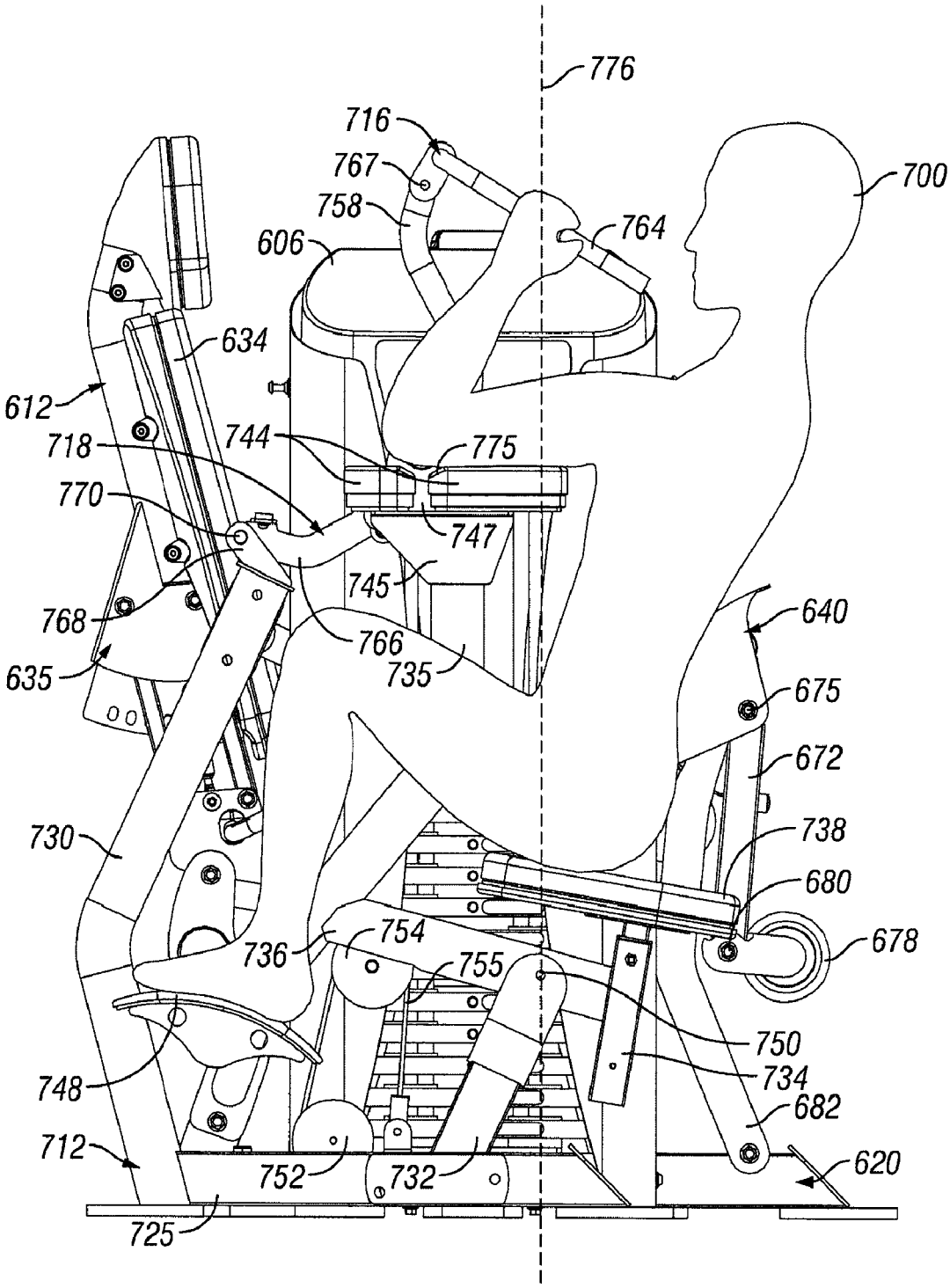
FIG. 24 is a side elevation view similar to FIG. 23 with the user in position, but illustrating the end position of the exercise.

As illustrated in FIG. 16, the arm or biceps curl exercise station 604 is mounted on the opposite side of the multi-station exercise machine to the leg exercise station 602. The biceps curl exercise station 604 is illustrated in more detail in the side elevation views of FIGS. 21 and 22, which illustrate exercise start and end positions, while FIGS. 23 and 24 illustrate the same positions with a user 700 performing a biceps curl exercise on the station. FIGS. 21 and 23 illustrate an exercise start position, while FIGS. 22 and 24 illustrate an exercise end position. The station 604 is also shown in the exercise end position in FIG. 16.

Biceps curl station 604 is similar or identical to the stand-alone biceps curl machine illustrated in FIGS. 1 to 5 of co-pending application Ser. No. 11/848,012 filed on Aug. 30, 2007, which is referenced above, the entire contents of which are incorporated herein by reference. Reference is made to that application for any details of the biceps curl station not described in detail herein. In alternative embodiments, station 602 may be replaced by any of the other embodiments described in co-pending application Ser. No. 11/848,012 referenced above, including triceps extension stations and convertible biceps curl/triceps extension stations. Station 604 has a main frame 712 attached to the weight stack housing 606, a user support frame 714 pivotally mounted on the frame via a pivot mount 715, and an exercise arm assembly 716 pivotally mounted on the user support frame and linked to the main frame via a pivoting connecting link 718 (see FIG. 22) so that movement of the exercise arm assembly results in pivoting movement of the user support. The user support frame 714 is linked to a weight stack 720 mounted in weight stack frame or housing 606 via a cable and pulley linkage 724.

The main frame 712 has a base section or strut 725 having a ground-engaging pad or foot 726 at each end, a transverse guide tube 728 (see FIG. 16) extending between the strut 725 and the base of weight stack frame 606, a first upright strut 730 at the forward end of base strut 725, and a rearward inclined, upright post or stand-off 732 at an intermediate point in the length of the strut. Pivot mount or bracket 715 is mounted at the upper end of post 732. A connecting rod 733 extends between forward strut 730 of the main frame and the rear side of the weight stack housing 606, as illustrated in FIG. 16

User support frame 714 has a seat support comprising a generally upright rear tube 734, a generally upright forward tube 735, and a cross bar or pivot mounting bar 736 extending between tubes 734 and 735. A seat pad 738 is adjustably mounted at the upper end of the rear tube 734 via seat support post 740 which is telescopically engaged in an open upper end of tube 734. Seat support post has a series of openings for releasable engagement with a pull pin to adjust the seat pad height based on user size and preference. Arm support pads 744 are mounted at the upper end of forward tube 735 via mounting brackets 745. Adjustment of the seat height accommodates users of different heights by varying the distance between the seat and the arm support pads. A pivot housing 747 extends upwardly from the upper end of the forward tube between the arm support pads. A foot support bar is transversely mounted at the lower end of tube 735 and a foot support 748 is mounted at each end of the support bar for engagement by a user's feet. Cross support 736 is pivotally attached to pivot mount 715 for rotation about user support pivot axis 750.

Cable and pulley linkage 724 includes a pulley 752 mounted on base strut 725 and a pulley 754 mounted on the underside of user support cross bar 736 approximate its forward end. Cable 755 extends from an anchor 756 on base strut 725, around pulley 754, and then around pulley 752. Cable 755 is then linked to the weight stack through the guide tube 728 in any suitable manner, including additional cables and pulleys.

Exercise arm assembly 716 comprises a main arm 758 having a pivot mount at one end pivotally connected between pivot brackets of the pivot housing 747 at the top of user support forward of upright tube 735 for rotation about first exercise arm pivot axis 762, and a generally U-shaped handle arm member 764 having a central region pivotally attached to a pivot mount 765 (see FIG. 16) at the forward end of main arm 758 for rotation about handle arm pivot axis 767. Each section or arm of the U-shaped handle arm member 764 has an angled step 771 that places the outer ends of the handle arm member at a wider spacing than the inner, web connecting portion. This design allows multiple gripping positions for the user's hands. The pivotal connection between the handle arm member and the main exercise arm enables the user engaging handles to self-align to the user during the exercise and automatically adjust to the user's arm length. A stand-off tube (not visible in the drawings) extends from the main arm pivot mount inside the pivot housing 747 at the top of user support.

Connecting link 718 comprises a link arm or bar 766 which is pivotally attached at one end to a link connecting pivot mount 768 at the upper end of main frame forward upright 730 for rotation about first pivot axis 770 (see FIG. 22). Link arm 766 is pivotally attached at its second end to a link connecting pivot mount 772 at the end of the stand-off tube of main arm 758 within the housing 747 for rotation about a second pivot axis (not visible in the drawings). The first pivot axis 770 of the connecting link is positioned above and forward of the user support pivot axis 750, as best seen in FIG. 22. A bumper plate 774 with a rubber bumper is mounted on connecting link arm 766 approximate the first pivot point 770, as illustrated in FIG. 22. Exercise arm 758 rests on bumper plate 774 in the rest or exercise start position.

In this embodiment, the user support is pivotally mounted to the main frame via the user support pivot mount 715. The exercise arm is pivotally connected to the pivot housing 747 located between the user support arm pads. The connecting link pivotally joins the main frame with the exercise arm via the link connecting pivot mount 768 at the upper end of main frame upright 730 and the link connecting pivot mount at the end of the main arm stand-off within pivot housing 747.

FIG. 21 illustrates the start position for a biceps curl exercise, while FIG. 22 illustrates the finish position. FIGS. 23 and 24 illustrate the same start and finish position with a user 700 seated on the machine and performing a biceps curl exercise. To perform the exercise, the user sits on the seat 738, which rests at a slight forward inclination, places their feet on the foot rests 748 and rests their upper arms on the angled arm support pads 744. The user aligns the pivot of their elbows as closely as possible with the pivot axis 762 at the exercise arm pivotal connection to the user support. Elbow groove 775 between the arm support pads 744 helps align the user. The user then grabs the user engaging handle 764 and starts the exercise movement by pulling the handle upward, towards their head.

This movement causes the exercise arm 716 to pivot about axis 762 relative to the user support, which rotates the stand-off secured to the main arm pivot mount 759 downward. As the stand-off rotates downward, it causes the connecting link 766 to rotate as it pivots about its connections to both the exercise arm and the main frame. This in turn forces the user support frame 714 to rotate, tilting it rearward about the user support pivot axis 750 at the user support's pivotal connection to the main frame. This pivot is designed to reorient the user's position from a forward lean to a rearward lean, duplicating the rearward arching motion of a "cheat" curl. This movement is done without changing the position of the user on the user support. Throughout the entire "cheat" movement, the user is in a stabilized position with their feet and upper torso supported. This stabilized position provides a strict exercise movement by preventing the involvement of other muscle groups and focusing effort just on the biceps.

FIGS. 23 and 24 show a user 700 on the machine in the start and finish positions respectively, with the vertical line 776 representing the gravitational centerline of the pivotal movement. The biceps curl exercise station places a portion of the user and user support frame on each side of the pivot's gravitational centerline in both the starting and finishing positions. By linking movement of the user support to movement of the exercise arm and positioning the user support pivot so that the combined weight of the user support frame and user is distributed on both sides of the pivot's gravitational centerline, the user support frame provides a counter-balancing effect on the exercise arm as it moves and its weight is re-distributed.

In the starting position, more of the combined weight of the user and user support frame is distributed towards the front side of the pivot. As the exercise arm is moved, more of this combined weight passes through the gravitational centerline until a more even distribution of weight is achieved. This re-distribution is gradual and continuous throughout the exercise motion and is not noticed by the user. By starting with a portion of the combined weight on the rearward or non-load side of the gravitational centerline, the initial lifting resistance is reduced. Re-distributing more of the combined weight to the non-load side at the end of the exercise increases the counter-balancing effect, lightening the resistive load slightly, which allows the user to come to full flexion and properly complete the exercise movement. This slight counter-balancing move mimics the momentum used on a free weight "cheat" curl to raise the weight to the top of its arc and finish the exercise.

The two exercise stations 602, 604 in the multi-station machine 600 of FIGS. 16 to 23 are linked to separate weight stacks and can be used completely independently from one another. Different types of exercise resistance may replace the weight stacks in alternative embodiments, and the isolation stations may be used in other multi-station machines such as those of FIGS. 1 to 15, together or in combination with other types of exercise stations including rocking seat exercise stations for performing compound movement exercises, as well as stationary seat exercise stations. The biceps curl and leg extension stations may be replaced by other isolation exercise stations, such as triceps extension, leg curl, or the like.

In each of the above embodiments, one or more stations of a multi-station exercise machine has a user support which is pivotally mounted for pivotal movement relative to a main frame, and a connecting linkage which translates movement of an exercise arm or user engagement device into movement of the user support. The stations with moving user supports may be designed for performing compound or isolation exercises.

The stations of the multi-station exercise machines of the above embodiments which have a pivoting or moving user support all have a vertical gravitational center line extending through the pivot axis (where there is a single user support pivot) or theoretical pivot axis (where there is a multiple pivot assembly for the user support). The gravitational centerline of the user support's pivotal movement is positioned so that the combined weight of the user support and user is distributed on both sides of the gravitational centerline in at least one of the exercise start and end positions. Because of this arrangement, the user support provides a counter-balancing effect on the exercise arm as it moves and its weight is re-distributed. This balanced weight distribution positions a portion of the user and user support on each side of the gravitational centerline in either the start or end position, or both the start and end position. As the exercise arm is moved, a portion of this combined weight passes through the gravitational centerline redistributing the weight. This re-distribution is gradual and continuous throughout the exercise motion and is not noticed by the user.

In each station having a pivoting user support, the user support has a primary user support portion which supports the majority of the user's weight in at least one of the start and end positions of the exercise, as well as at least one additional or secondary user support portion which stays in the same position relative to the primary user support portion throughout the exercise, and supports a spaced portion of the user's body. An additional user support which supports another part of the user's body may also be provided. The multiple user supports provide secure and safe positioning, placing the user in the proper exercise alignment from start to finish, without any adjustment required by the user. The primary and secondary supports may be a seat pad and back pad, a seat pad and chest pad, a seat pad and thigh hold down pad, a seat pad and foot support, a back pad and shoulder pads, or other combinations of supports. The primary and secondary support travel together in fixed alignment to keep the user in the same position throughout the exercise motion so that the user does not have to worry about balancing on a moving platform or pad. In some embodiments, more than two user support portions may be provided on the user support frame, and also travel together with the primary and secondary supports for increased stability. For example, in some embodiments a foot plate to provide a rest for the user's feet during travel of the user support may be provided in addition to a back pad, chest pad, or thigh hold down pad, or hand grips may be provided in addition to a back pad and shoulder pads.

In each station with a pivoting user support, the connecting linkage which translates the user engagement device movement into movement of the user support is associated with at least two of the user engagement device, user support, and main frame. In some embodiments, such as the rear deltoid station of FIGS. 1 to 4, the connecting linkage is associated with all three of the user engagement device, user support, and main frame. The connecting linkage may have multiple parts or comprise a single rigid link, articulated links, completely flexible links, a sliding wedge link or rolling carriage, and the like, and the connecting linkage may be made adjustable.

The user engagement device may have linked or separate exercise arms movable in straight, parallel paths, diverging paths, or converging paths during an exercise, or may be a pivotally mounted exercise arm. The exercise arm or arms may be movably mounted on the main frame, connecting linkage, or user support frame, and may be partially flexible or articulated to allow user-defined movement of the user engagement device, or may be rigid arms. In those stations where the exercise arm is engaged by the user's hands rather than their feet, the handles may be rigid or flexible, and the exercise arm may provide for two-dimensional or three-dimensional movement.

In the exercise stations of the above embodiments which have moving user supports, operation of the user engagement device causes a rocking movement of the user support. Due to the position of the user support pivot or the theoretical pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the various embodiments may be mixed and interchanged with one another, and different types and forms of components could be used without affecting the scope of the invention. Cables could be replaced with belts, ropes, chains, or the like, and pulleys could be replaced with sprockets. The seat and/or back pad could be fixed or made adjustable. Various different types of user engaging pads can be used. The exercise arm or user engagement device could be unidirectional or bi-directional, and may be in one piece (dependent) or two pieces for independent arm movement. The exercise arm may be mounted on the user support, main frame, or connecting linkage, and the exercise arm movement may be rotational, linear, converging, or diverging, and may be user-defined.

The user support and user engagement device could be designed to travel in the same or opposite directions. The user support pivot mount may have a single pivot or multiple pivots, and in the latter case the user support pivots about a theoretical pivot mount of the combined pivotal motion. Any of the various embodiments could have the resistance associated with any of the moving parts (user support, user engagement device, or connecting linkage). The exercise resistance may be a weight stack linked to part of the apparatus by a cable and pulley arrangement, or may be weight plates. Any other type of resistance known in the art may alternatively be used, such as hydraulic, pneumatic, electromagnetic, or elastic bands, in place of the weight stack or weight plates.

In each multi-station machine, the user support in each station is positioned relatively low to the ground in the start and end position, making the stations quicker, easier, and safer to enter and exit. The user does not have to climb up or down in order to get into, or out of, the exercise position. The low profile also makes the machines more economical to produce and less intimidating to the user. The user's position is continuously adjusted throughout the exercise. The combined exercise arm and user support movement produces an automatic and continuous self-aligning exercise motion.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A multi-station exercise machine, comprising:

first and second exercise stations for performing first and second exercises, respectively;

the first and second exercise stations having respective first and second main frame portions, respective first and second user engagement devices which are engaged by the user to perform the first and second exercise, respectively, and respective first and second user support frames which are configured to support respective first and second users simultaneously in exercise ready positions while the users perform independent first and second exercises, at least the first user support frame comprising a movable user support frame;

the first exercise station having first pivot assembly pivotally mounting the first user support frame relative to the first main frame portion which allows rotation of the first user support frame between a start position and an end position, the pivot assembly having at least one pivot and defining a vertical gravitational center line of the pivotal movement of the first user support frame;

the first user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

the first user engagement device being movably mounted relative at least one of the first user support frame and the first main frame portion;

a first connecting linkage which translates movement of the first user engagement device to movement of the first user support frame; and a first load for resisting movement of at least one of the first user support frame, first user engagement device, and first connecting linkage.

2. The machine of claim 1, wherein the user support pivot assembly is positioned such that portions of the combined weight of the user and first user support frame are distributed on each side of the vertical gravitational center line in at least one of the start and end positions of the first exercise and only a portion of the combined weight passes through the gravitational center line during the exercise movement.

3. The machine of claim 1, wherein the second exercise station has a second movable user support frame which is movable independently from the first movable user support frame and a second connecting linkage which translates movement of the second user engagement device to movement of the second user support frame.

4. The machine of claim 1, wherein the second exercise station has a stationary user support frame.

5. The machine of claim 1, wherein the load comprises a selectorized weight stack.

6. The machine of claim 1, further comprising a second load associated with the second exercise station and not associated with the first exercise station.

7. The machine of claim 6, wherein at least one of the loads comprises a selectorized weight stack.

8. The machine of claim 6, wherein at least one of the loads comprises hand loaded weight plates.

9. The machine of claim 6, wherein both loads comprise selectorized weight stacks and the loads are positioned together between the first and second exercise stations.

10. The machine of claim 6, wherein the loads comprise hand loaded weight plates on the respective exercise stations, and the main frame portions of the exercise stations are connected together.

11. The machine of claim 1, further comprising a common main frame base extending between the two exercise stations, the main frame portions of the respective exercise stations comprising spaced parts of the common main frame base.

12. The machine of claim 5, wherein the second exercise station is associated with the selectorized weight stack, whereby the same weight stack provides exercise resistance for both the first and second exercise station.

13. The machine of claim 1, further comprising a third exercise station which is different from the first and second exercise stations and configured for performing a different type of exercise from the first and second exercise stations.

14. The machine of claim 13, wherein the third exercise station has a third main frame portion, a third user support frame associated with the third main frame portion, and a third user engagement device movable with respect to at least one of the third user support frame and third main frame portion.

15. The machine of claim 13, wherein at least two of the exercise stations have movable user support frames.

16. The machine of claim 13, wherein all of the exercise stations have movable support frames.

17. The machine of claim 13, wherein the third exercise station has a movable user support frame and a third connecting linkage which translates movement of the third user engagement device to movement of the third user support frame.

18. The machine of claim 1, wherein the first user support frame supports a user in a seated position and the primary support comprises a seat pad.

19. The machine of claim 18, wherein the secondary support comprises an upper body engaging pad.

20. The machine of claim 19, wherein the secondary support comprises a back pad.

21. The machine of claim 19, wherein the secondary support comprises a chest pad.

22. The machine of claim 18, wherein the secondary support comprises a thigh hold down device.

23. The machine of claim 1, wherein the first user support frame supports a user in a prone position.

24. The machine of claim 23, wherein the first user engagement device comprises a leg exercise arm.

25. The machine of claim 23, wherein the primary support comprises a back pad.

26. The machine of claim 23, wherein the secondary support comprises shoulder pads.

27. The machine of claim 1, wherein the first user support frame has an additional support which supports a different part of a user's body from the primary and secondary supports.

28. The machine of claim 1, wherein the first pivot assembly comprises a pivot mount on the first main frame portion and a single pivot connection on the pivot mount which pivotally connects the user support frame to the mainframe.

29. The machine of claim 28, wherein the pivot mount is located beneath a user positioned on the user support frame.

30. The machine of claim 1, wherein the first pivot assembly comprises a four-bar pivot system pivotally connecting the user support frame to the first main frame portion.

31. The machine of claim 1, wherein the first user engagement device is rotatably mounted relative to one of the first user support frame and first main frame portion.

32. The machine of claim 1, wherein the first user engagement device is movable in a linear path.

33. The machine of claim 1, wherein the first user engagement device is movable in a user-defined path.

34. The machine of claim 1, wherein the first user engagement device comprises first and second handles and first and second arm portions extending from the respective handles and associated with at least one of the first main frame portion, first user support frame, and first connecting linkage.

35. The machine of claim 34, wherein each arm portion is at least partially non-rigid.

36. The machine of claim 1, wherein the first user engagement device comprises first and second rigid exercise arms rotatable relative to the frame about a common pivot axis, each exercise arm having a handle for gripping by a user positioned on the user support frame.

37. The machine of claim 36, wherein the exercise arms are joined to move together in an exercise movement.

38. The machine of claim 36, wherein the exercise arms are independently movable.

39. The machine of claim 1, wherein the first exercise is selected from the group consisting of a pectoral fly exercise, an upper back exercise, a chest press exercise, a shoulder press exercise, a leg press exercise, a seated dip exercise, a leg extension exercise, a leg curl exercise, a biceps curl exercise, a triceps extension exercise, and a chin up exercise.

40. The machine of claim 1, wherein the user engagement device and user support frame of the first exercise station move in opposite directions during an exercise.

41. The machine of claim 1, wherein the user engagement device and user support frame of the first exercise station move in the same direction during an exercise.

42. The machine of claim 1, wherein portions of the combined weight of the user and user support frame of the first exercise station are distributed on both sides of the gravitational center line in both the start and end position of an exercise.

43. The machine of claim 1, wherein at least one of the exercise stations is a compound movement exercise station.

44. The machine of claim 1, wherein at least one of the exercise stations is an isolation exercise station.

45. A multi-station exercise machine, comprising:

a main frame assembly having a plurality of main frame portions;

a plurality of exercise stations located on different portions of the main frame assembly and adapted for performing different exercises;

each exercise station having a user support frame which supports a respective user in an exercise position independently from users supported on user support frames at the other exercise stations and a user engagement device which is moved by a user when performing exercises at the respective station independent from exercises performed at the other stations;

at least one of the exercise stations comprising a moving support exercise station, the moving support exercise station having a moving user support frame which is pivotally mounted relative to a respective portion of the main frame assembly for rotation between exercise start and end positions, a connecting linkage which translates movement of the user engagement device of the moving support exercise station into movement of the moving user support frame, and a load which resists movement of at least one of the moving user support frame, the user engagement device, and the connecting linkage; and the moving user support frame having at least a primary support and a secondary support for supporting spaced positions on a user's body throughout an exercise movement, the secondary support being fixed at a predetermined angular orientation relative to the primary support during the exercise movement, and the primary support supporting the majority of a user's weight in the start position of the support frame.

46. The machine of claim 45, wherein all of the exercise stations comprise moving support exercise stations.

47. The machine of claim 45, wherein only one of the exercise stations comprises a moving support exercise station.

48. The machine of claim 45, wherein the load provides exercise resistance to each exercise station.

49. A multi-station exercise machine, comprising:

a main frame assembly having a plurality of main frame portions;

a plurality of exercise stations located on different portions of the main frame assembly and adapted for performing different exercises;

each exercise station having a user support frame which supports a respective user in an exercise position independently from users supported on user support frames at the other exercise stations and a user engagement device which is moved by a user when performing exercises at the respective station independent from exercises performed at the other stations;

at least one of the exercise stations comprising a moving support exercise station, the moving support exercise station having a moving user support frame which is pivotally mounted relative to a respective portion of the main frame assembly for rotation between exercise start and end positions, a connecting linkage which translates movement of the user engagement device of the moving support exercise station into movement of the moving user support frame, and a load which resists movement of at least one of the moving user support frame, the user engagement device, and the connecting linkage;

the moving user support frame having at least a primary support and a secondary support for supporting spaced positions on a user's body throughout an exercise movement, the secondary support being fixed at a predetermined angular orientation relative to the primary support during the exercise movement, and the primary support supporting the majority of a user's weight in the start position of the support frame; and each exercise station has an independent load providing exercise resistance for the exercise performed at the respective exercise station.

50. The machine of claim 49, wherein the frame assembly includes a central array of weight stacks, each frame portion being associated with a respective weight stack, the load for each exercise station comprising a respective weight stack.

51. The machine of claim 49, wherein the load for each exercise station comprises weight plates.

52. The machine of claim 45, wherein the moving user support defines a gravitational center line of the user support pivotal motion, and the gravitational center line is positioned such that portions of the combined weight of the user support frame and a user positioned on the moving user support frame are distributed on each side of the gravitational center line of the pivotal motion in at least, one of the start and end position and only a portion of the combined weight passes through the gravitational center line during the exercise movement.

53. The machine of claim 45, wherein the moving user support frame has a base, the primary user support comprises a pad on the base which supports a user, and a pivot assembly between the base and an underlying main frame portion of the moving support exercise station pivotally mounts the moving user support frame relative to the underlying main frame portion.

54. The machine of claim 53, wherein the pivot assembly comprises a four bar pivot linkage between the bases of the user support frame and the main frame.

55. The machine of claim 53, wherein the user support pivot assembly comprises a pivot mount on the main frame portion and a pivot connection between the pivot mount and the base of the user support frame.

56. The machine of claim 45, wherein there are at least two exercise stations.

57. The machine of claim 56, wherein all of the exercise stations comprise moving support exercise stations.

58. The machine of claim 56, wherein the exercise stations are mounted on aligned portions of the main frame assembly.

59. The machine of claim 45, wherein at least one moving support exercise station has a flexible connecting linkage.

60. The machine of claim 45, wherein at least one moving support exercise station has a multiple part connecting linkage.

61. The machine of claim 45, wherein the moving user support frame of at least one exercise station rocks forward between the start and end position of an exercise.

62. The machine of claim 45, wherein the moving user support frame of at least one exercise station rocks rearward between the start and end position of an exercise.

63. The machine of claim 45, wherein the moving user support frame and user engagement device of at least one exercise station travel in opposite directions.

64. The machine of claim 45, wherein the moving user support frame and user engagement device of at least one exercise station travel in the same direction.

65. The machine of claim 45, wherein at least one of the user supports on the moving user support frame is adjustable.

66. The machine of claim 45, wherein the user engagement device of at least one exercise station is movably mounted on the main frame portion of said one exercise station.

67. The machine of claim 45, wherein the user engagement device of the moving support exercise station is movably mounted on the user support frame.

68. The machine of claim 45, wherein the connecting linkage is adjustable.

69. The machine of claim 45, wherein the connecting linkage is rigid.

70. The machine of claim 45, wherein the connecting linkage is flexible.

71. The machine of claim 45, wherein the moving user support travels through a horizontal orientation during an exercise movement.

72. The machine of claim 45, wherein the exercise stations comprise at least two exercise stations facing in opposite directions.

73. The machine of claim 45, wherein the exercise stations comprise at least two exercise stations located side-by-side.

74. The machine of claim 45, wherein the main frame assembly has a central region and the exercise stations extend radially from said central region.

75. The machine of claim 45, wherein at least one station is a compound movement exercise station.

76. The machine of claim 45, wherein at least one station is an isolation exercise station.

* * * * *